US008028494B2

(12) United States Patent
Denn et al.

(10) Patent No.: US 8,028,494 B2
(45) Date of Patent: Oct. 4, 2011

(54) SLEEVE CONNECTORS FOR METAL GIRDERS

(75) Inventors: Andrew Denn, Portslade (GB); Nigel May, Portslade (GB)

(73) Assignee: Denmay Steel, East Sussex (GB)

( * ) Notice: Subject to any disclaimer, the term of this patent is extended or adjusted under 35 U.S.C. 154(b) by 267 days.

(21) Appl. No.: 12/101,554

(22) Filed: Apr. 11, 2008

(65) Prior Publication Data

US 2009/0100796 A1 Apr. 23, 2009

(51) Int. Cl.
*E04C 3/00* (2006.01)

(52) U.S. Cl. ..... 52/848; 52/289; 52/655.1

(58) Field of Classification Search ..... 52/848, 52/289, 702, 655.1; 403/218, 232.1, 233, 403/261, 262, 387
See application file for complete search history.

(56) References Cited

U.S. PATENT DOCUMENTS

| | | | | | |
|---|---|---|---|---|---|
| 508,280 | A | | 11/1893 | Cavallaro | |
| 1,555,847 | A | * | 10/1925 | Hudson | 403/306 |
| 2,234,960 | A | * | 3/1941 | Buelow | 403/233 |
| 3,462,021 | A | * | 8/1969 | Hawke et al. | 211/182 |
| 3,740,084 | A | * | 6/1973 | Tellberg | 403/171 |
| 4,076,431 | A | * | 2/1978 | Burvall | 403/171 |
| D255,645 | S | * | 7/1980 | West | D8/382 |
| 4,227,358 | A | * | 10/1980 | Gat | 52/655.1 |
| 5,046,878 | A | * | 9/1991 | Young | 403/13 |
| 5,967,498 | A | * | 10/1999 | Junell | 256/19 |

FOREIGN PATENT DOCUMENTS

| | | | |
|---|---|---|---|
| FR | 2858040 | A1 | 7/2003 |
| GB | 431960 | | 8/1935 |
| GB | 552283 | | 3/1943 |
| GB | 838828 | | 6/1960 |
| GB | 1431122 | | 4/1976 |
| GB | 2396630 | A | 6/2004 |
| JP | 10061006 | A | 8/1996 |
| JP | 2003193571 | A | 12/2001 |
| WO | 02095153 | A1 | 11/2002 |

* cited by examiner

*Primary Examiner* — Jeanette E Chapman
*Assistant Examiner* — Daniel Kenny
(74) *Attorney, Agent, or Firm* — Hayes Soloway P.C.

(57) ABSTRACT

A connector sleeve 22 is disclosed for connecting two beams 2,4 together in the construction industry which is quick and easy to use and which may be moved or removed if required. The sleeve 22 comprises opposing walls 25,26 for receiving the end portions of two beams 2,4 therebetween and clamping means 32 integrally mounted on one of the opposing walls 25,26. The clamping means 32 is configured to releasably engage the beams 2,4 in use so as to fix their location relative to each other. A modular connection assembly for connecting two beams is also disclosed herein.

48 Claims, 13 Drawing Sheets

SLEEVE CONNECTORS FOR METAL GIRDERS

The present invention relates to devices and methods for connecting beams together, preferably metal beams such as steel beams or girders for use within the construction industry.

Conventional construction techniques involve a structural engineer designing the structure and components of the construction specifically for a given project. The lengths of the structural beams and the type and location of the connections between the beams required for the construction are accurately determined in advance. The beams and the connection components are then manufactured in a fabrication workshop specifically for the project in hand. Once the components have been designed, ordered, manufactured and delivered to the construction site, the structural beams can then be welded and/or bolted together using the specially fabricated connection components to form the structure.

Whilst the above-described conventional techniques produce acceptable constructions they require highly skilled labour, are extremely time consuming and are relatively expensive. Furthermore, if a mistake has been made in designing the connection components, or a mistake is made when welding and bolting the components together, a significant and costly delay results.

The present invention provides improved apparatus and methods for connecting beams.

According to a first aspect the present invention provides a connector sleeve for use in connecting first and second elongated beams, the sleeve comprising openings for receiving end portions of the beams and opposing walls extending between the openings;

wherein the sleeve is provided with clamping means movable into engagement with the beams in use so as to clamp the beams in a fixed position relative to each other within the sleeve.

The connector sleeve of the present invention is significantly faster and more simple to use than the conventional techniques described above as the beams may simply be inserted into the sleeve and the clamping means used to fixedly connect the two beams together. Precise designing and exact measurements of the connection are not required. Instead, the builder is able to take the beams and connector sleeve and fit them together at the construction site on the same day.

The connector sleeve is preferably for use in connecting weight bearing beams such as, for example, beams for use in the building construction industry. The connector sleeve is preferably sized and configured for use in connecting metal girders used in the building construction industry. However, in less preferred embodiments, the connector sleeve may be used to connect a metal beam to another type of beam, such as a wooden or plastic beam, or to connect wooden and/or plastic beams together.

The connector sleeve has a first opening for receiving the end portion of the first beam and a second opening for receiving the end portion of the second beam. Preferably, the sleeve comprises a hollow chamber and is configured to extend around four sides of each beam so as to substantially enclose the entire circumference of the end portion of each of the beams in use. Less preferably, the sleeve may be a U-shaped bracket to be arranged around only three sides of the beam and not all four sides.

The openings for receiving the beams are preferably located at opposite ends of the sleeve such that the end faces of the beams face each other within the sleeve. The sleeve is preferably configured such that the end faces of the beams can abut one another within the sleeve. Alternatively, the sleeve may be configured to maintain the ends of the beams spaced apart from each other, for example, by including stop members located on an inner wall of the sleeve.

In other embodiments the connector sleeve is configured to receive the axes of the beams at angles to each other. For example, the connector sleeve may be configured so that the beams can be received at right angles to each other. The sleeve may include three, four or more openings for receiving the end portions of three, four or more beams. For example, the connector sleeve may be configured to connect three beams at a T-shaped connection, or four beams at a cross-shaped connection.

Most preferably the sleeve is configured to receive metal beams having I-shaped cross-sections such as those used to construct buildings, i.e. beams comprising top and bottom parallel flanges and a web extending perpendicular to the flanges and centrally therebetween. Therefore, according to the preferred embodiment the cross-sections of the openings and the hollow chamber of the sleeve are preferably square or rectangular. However, in less preferred embodiments the cross-sections may be I-shaped, or other shapes depending upon the cross-section of the beams which are to be connected.

The sleeve is preferably configured to receive the end portions of beams having a dimension perpendicular to the axis of the beam (e.g. width and/or height) selected from the group consisting of: ≧60 mm; ≧80 mm; ≧100 mm; ≧120 mm; ≧140 mm; ≧160 mm; ≧180 mm; ≧200 mm; ≧220 mm; ≧240 mm; ≧260 mm; ≧280 mm; and ≧300 mm. Most preferably, the connector sleeve is configured to receive one of the standard sizes of I-shaped metal beam used in the construction industry. For example, the connector sleeve may be sized and configured to receive a beam having a maximum height in the direction perpendicular to the flanges by the maximum width of the flanges of 127×76 mm, 152×152 mm or 203×133 mm.

The sleeve is preferably sized and configured so as to accept the beams with sufficient clearance to axially insert the beams through the openings in the sleeve, but such that the beams cannot move significantly in directions other than axially within the sleeve. Therefore, in the preferred embodiment the openings and/or hollow chamber of the sleeve have a height and/or width selected from the group consisting of: 60-300 mm; 65-280 mm; 70-260 mm; 75-240 mm and 80-220 mm.

At least one viewing aperture is preferably located in one or more of the sleeve walls between the openings which receive the beams in use. This enables the user to determine when the beams are located in their correct position within the sleeve. Most preferably, the viewing aperture is located midway between the openings. This enables the user to determine when each beam has been inserted half way through the housing such that the ends of the beams abut each other in the centre of the housing. In other embodiments it may be desirable to receive a longer length of one beam than the other, or to provide a gap between the ends of the beams within the housings. In these embodiments one or more viewing aperture may be arranged closer to one of the openings for receiving the beams than the other opening. Preferably, the at least one viewing aperture is circular, although the viewing apertures may be any shape and/or different shapes.

According to another aspect, the present invention provides an assembly comprising a combination of any one of the above connector sleeves and the beams.

In the preferred embodiments the beam(s) to be connected each have a weight of ≧10 kg; ≧20 kg; ≧30 kg; ≧40 kg; ≧50 kg; ≧75 kg; or ≧100 kg.

According to another aspect, the present invention provides a method of connecting two beams comprising inserting the end portions of first and second beams into any one of the connector sleeves described above and clamping the beams in a fixed position relative to each other within the sleeve using the clamping means.

According to another aspect, the present invention provides a modular connection assembly for connecting first and second beams, the connection assembly comprising:

a connector sleeve comprising opposing walls defining a region therebetween for receiving a portion of a first beam, and further comprising an end or side wall for connecting to a beam hanger, wherein the sleeve is provided with clamping means movable into engagement with the first beam in use so as to clamp the first beam in a fixed position between the opposing walls;

a beam hanger configured to receive and support a second beam in use; and connecting means for connecting the connector sleeve to the beam hanger thereby connecting the first and second beams to one another in use.

According to one set of embodiments, the connector sleeve may have any of the preferred features described above in relation to the connector sleeve according to the first aspect of the invention.

According to these embodiments, a side wall of the connector sleeve comprises at least one aperture for use in connecting the connector sleeve and the beam hanger using the connecting means. Most preferably the side wall comprises a plurality of apertures, preferably arranged in at least one row and/or at least one column. This enables the connector sleeve and beam hanger to be connected to each other at multiple different horizontal and/or vertical positions relative to each other.

According to another set of embodiments the connector sleeve is an end box for mounting over the free end of the first beam in use.

The end box connector sleeve may have any of the preferred features described above in relation to the connector sleeve according to the first aspect of the present invention, except that the end box comprises only one opening for receiving the first beam and terminates in an end wall located on the end box opposite to the opening for receiving the first beam.

According to the preferred embodiment, the end wall of the end box comprises at least one aperture for use in connecting the end box and the beam hanger using the connecting means. Most preferably the end wall comprises a plurality of apertures, preferably arranged in at least one row and/or at least one column. This enables the end box and beam hanger to be connected to each other at multiple different horizontal and/or vertical positions relative to each other.

Additionally, or alternatively, at least one aperture may be provided in a wall of the end box other than the end wall so that a beam hanger may be connected to a wall of the end box other than the end wall.

In an alternative set of embodiments the connector sleeve is configured to be clamped onto a single flange of the first beam. The connector sleeve comprises an end wall for use in connecting to the beam hanger and preferably has an upper wall for contacting an upper side of the first beam in use. The end wall preferably extends substantially perpendicularly to the upper wall.

In a preferred embodiment the connector sleeve is configured to be mounted to the first beam such that the upper wall extends across the width of the first beam and the end wall extends down the side of the beam. In this embodiment the opposing walls of the connector sleeve are preferably formed by a lipped portion on the upper wall. In other words the upper wall preferably comprises a portion which extends away from the end wall and turns back on itself so as to extend back towards the end wall. In this manner the lipped portion is able to receive part of a flange of the first beam between its opposing walls. This embodiment is particularly advantageous in that it allows the beam hanger to be connected to the connector sleeve at the side of the first beam.

In an alternative embodiment the opposing walls are not formed by a lipped portion but are formed by a beam receiving portion comprising the upper wall and a lower wall. In this embodiment the upper and lower walls are connected to the end wall and are preferably both arranged perpendicular thereto. In this embodiment the lateral portion of a flange of the first beam may be received between the upper and lower walls with the end wall hanging down the side of the beam. In a modification of this embodiment the connector sleeve is configured to be connected to the first beam such that the end wall of the connector sleeve is parallel to the end face of an I-shaped beam. In this embodiment, the lower wall is divided into two spaced apart portions, which are spaced apart in a direction parallel to the end wall. This embodiment enables the flange of the I-shaped beam to be received between the upper and lower walls whilst the web of the beam passes between the spaced apart portions of the lower wall. In this embodiment the clamping means may be provided on one or both of the spaced apart portions of the lower wall.

In all of the above connector sleeve embodiments wherein the sleeve is configured to be clamped onto a single flange of the first beam, the opposing walls are preferably spaced apart by an amount selected from the group consisting of: ≦35 mm; ≦30 mm; ≦25 mm; ≦20 mm; ≦15 mm; ≦10 mm; and ≦5 mm.

The end wall of the connector sleeves configured to be clamped onto a flange of the first beam preferably has at least one aperture for use in connecting the connector sleeve and beam hanger using the connecting means. Most preferably, the end wall comprises a plurality of apertures, which are preferably arranged in at least one row and/or at least one column. This enables the connector sleeve and beam hanger to be connected to each other at multiple different horizontal and/or vertical positions relative to each other.

In one embodiment the connection assembly comprises two connector sleeves which each clamp onto a flange of the first beam. In this embodiment the connector sleeves may engage both flanges of a beam in use with their end walls extending between the flanges on the same side of the beam. The beam hanger can then be coupled to the end walls of the connector sleeves using the connecting means.

In all of the above connector sleeves (including those for receiving more than one beam) the clamping means is configured to be moved into engagement with the beam(s) in use so as to clamp the beam(s) in a fixed position. Preferably, the clamping means is configured to releasably engage the beam (s). As such, if errors are made during the construction process then the beam(s) may be removed from the connector sleeve with minimal time and effort.

The clamping means is preferably an integral part of the connector sleeve and therefore at least part of the clamping means is preferably permanently coupled to at least one of the sleeve walls.

The clamping means preferably comprises means for forcing the beam(s) against a wall of the connector sleeve. Preferably, the connector sleeve comprises two opposing walls and the clamping means is arranged on one wall and forces the beam(s) against the opposite wall in use. According to the preferred embodiment, the clamping means comprises at least one bolt and at least one bolt receiving means for receiving the at least one bolt. The bolt and bolt receiving means are configured to cooperate so as to maintain the beam(s) clamped, preferably with the bolts in contact with the beams in use. Preferably, the bolt has an external screw thread and the bolt receiving means has an internal screw threaded bore for co-operating with the external screw thread on the bolt. In the embodiments wherein the connector sleeve receives two or more beams, at least one bolt and bolt receiving means is provided for clamping each beam in use.

According to the preferred embodiment the bolt receiving means is permanently coupled to one of the opposing walls of the sleeve. The head of the bolt and the bolt receiving means are preferably provided on an outwardly facing surface of the opposing walls. Less preferably, the bolt receiving means may be provided on an inwardly facing surface of the opposing walls. In either case the bore of each bolt receiving means is centred about an aperture through the sleeve wall on which it is located such that the bolt(s) may be inserted or screwed through the wall and into contact with the beam(s) in use. In a less preferred embodiment the bolt receiving means is merely formed by an aperture in the sleeve wall.

It should be noted that the connector sleeve of the present invention is not limited to the use of bolts for clamping the beam(s). Any other means suitable for clamping the beam(s) may be used in the present invention such as, for example, ratchet means, grub screw fixings, or less preferably rivets. In the embodiments wherein the connector sleeve receives more than one beam, different clamping means may be provided for engaging the different beams.

The connection assembly comprises a beam hanger. The beam hanger preferably comprises an end wall for connecting to the connector sleeve using the connecting means, and a base wall for supporting the end of the second beam in use. In the preferred embodiment the beam hanger end wall comprises at least one aperture for use in connecting the beam hanger to the connector sleeve using the connecting means. Most preferably the beam hanger end wall comprises a plurality of apertures, which are preferably arranged in at least one row and/or at least one column. This enables the beam hanger and connector sleeve to be connected to each other at multiple different horizontal and/or vertical positions relative to each other.

The beam hanger preferably further comprises opposing side walls joining the end wall and base wall. According to a preferred embodiment one or both of the side walls comprises at least one aperture. This embodiment is particularly advantageous, for example, when a timber beam is to be received in the beam hanger as the timber beam may be nailed in place in the beam hanger through the at least one aperture in the side wall.

Additionally, or alternatively, the base wall preferably comprises at least one slot-shaped aperture extending in a direction between the side walls.

The beam hanger preferably further comprises a refastenable locking member arranged in each slot-shaped aperture and configured to limit the movement of the second beam in the direction between the side walls in use. Most preferably, the base wall comprises two slot-shaped apertures which are spaced apart in the direction between the side walls and which each include a refastenable locking member. This enables the location of the second beam between the side walls to be adjusted and/or allows for different sizes of beams to be fixedly held in the same sized beam hanger.

In a preferred set of embodiments, the beam hanger comprises an end box for receiving the free end of the second beam in use. The beam hanger end box may have any one or combination of the preferred features of the connector sleeve end box described above.

The connecting means of the connection assembly preferably comprises means for releasably connecting the connector sleeve and beam hanger. Preferably, the connecting means comprises means for connecting the connector sleeve and beam hanger through apertures in the side or end walls of the connector sleeve and the end wall of the beam hanger. In the preferred embodiment the connecting means comprises at least one bolt and at least one corresponding bolt receiving means. At least one bolt receiving means may be provided permanently coupled to the side or end wall of the connector sleeve so that the beam hanger can be bolted thereto. However, connecting means other than bolts and bolt receiving means may be used. For example, ratchet means, grub screw fixings or rivets may be used to connect the connector sleeve and beam hanger.

The connecting means preferably further comprises an adaptor plate configured to be connectable to the connector sleeve and beam hanger. The adaptor plate preferably comprises at least two apertures for use in connecting the adaptor plate to the connector sleeve and beam hanger. Most preferably the adaptor plate comprises a plurality of apertures arranged in at least one row and/or at least one column. This enables the connector sleeve and beam hanger to be connected to each other at multiple different horizontal and/or vertical positions relative to each other. At least one bolt receiving means is preferably permanently coupled to the adaptor plate such that a bolt can be passed through one of the apertures in the adaptor plate and into its bolt receiving means. In this manner a bolt can be used to connect the connector sleeve and/or beam hanger to the adaptor plate.

Preferably, the connector sleeves and/or beam hangers of the present invention are constructed from metal, and more preferably from steel. Mild steel is particularly preferred for fabricating the components. However, other metals and less preferably rigid plastics may be used.

According to another aspect the present invention provides a method of connecting first and second beams using any one of the modular connection assemblies described above, the method comprising:

arranging the connector sleeve so as to receive a portion of the first beam between the opposing walls;

clamping the first beam in a fixed position between the opposing walls using the clamping means;

connecting the beam hanger to the connector sleeve using the connecting means; and inserting a second beam into the beam hanger.

The connector sleeve of the connection assembly is novel in its own right. Therefore, from a further aspect the present invention provides a connector sleeve for use in connecting two beams, the sleeve comprising opposing walls defining a region therebetween for receiving a portion of a first beam, and further comprising an end or side wall for connecting to a beam hanger which receives a second beam in use, wherein the sleeve is provided with clamping means which is moveable into engagement with the first beam in use so as to clamp the first beam in a fixed position between the opposing walls.

Preferably, the end or side wall comprises at least one aperture for use in connecting the connector sleeve to the beam hanger.

Various embodiments of the present invention and illustrative prior art arrangements will now be described, by way of example only, and with reference to the accompanying drawings, in which.

The differences between the devices and methods according to the preferred embodiments of the present invention and conventional techniques for connecting beams will now be illustrated by referring to the accompanying drawings.

In the construction industry it is frequently necessary to cut a metal beam into two or more lengths in order to pass them into their desired location within the construction. Once the beams are in their desired location they need to be re-connected to effectively form a beam of the original length.

Figure 1A:
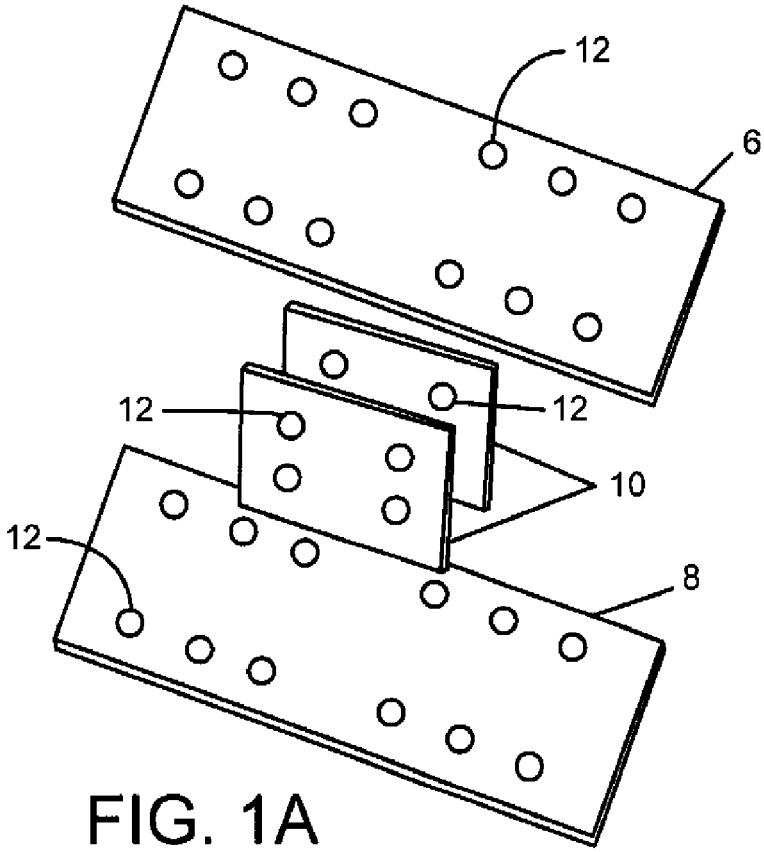
FIG. 1A PRIOR ART
FIG. 1A shows metal plates for connecting the ends of two metal beams according to a conventional technique and FIG. 1B shows the ends of the metal beams to be connected together by the plates.
Figure 1B:
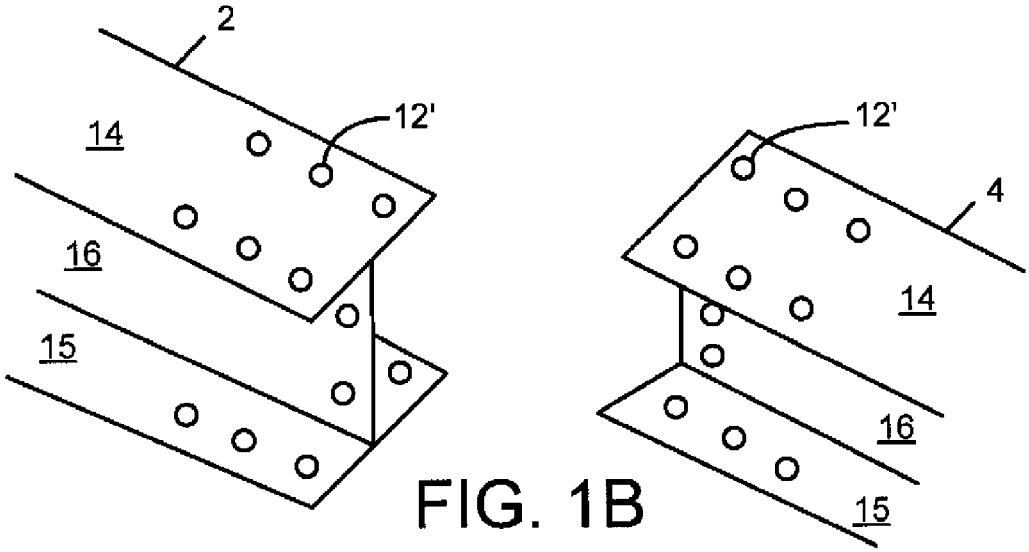
FIG. 1B PRIOR ART

FIGS. 1A-1B illustrate a conventional technique for re-connecting two beams 2,4 having an I-shaped cross-section. Prior to cutting the beam into two beams 2,4, top 6, bottom 8 and side 10 connecting plates are designed and fabricated for use in re-connecting the ends of the two beam portions 2,4, as shown in FIG. 1A. The connecting plates 6,8,10 are punched or drilled to form holes 12 for accepting bolts. Typically twenty or more holes 12 are formed in each connecting plate 6,8,10. The plates 6,8,10 are then temporarily welded to the beam across the point at which the beam is to be cut into two beams 2,4. Holes 12' are then drilled through the flanges 14,15 and web 16 of the beam through the holes in the connecting plates 6,8,10 so as to form holes 12' in the beam which correspond to the holes 12 in the connecting plates 6,8,10. The connecting plates 6,8,10 are then removed from the beam and the beam is cut into two beams 2,4 with a saw or by gas. The beam is cut through its cross-section at the location corresponding to the plane in which the centres of the connecting plates 6,8,10 were located.

As the two beams 2,4 are shorter than the length of the original beam they may then be inserted into their intended position in the construction and reconnected end-to-end to effectively form a single beam of the original length. The top and bottom plates 6,8 are then bolted to the top and bottom 14,15 flanges of the beam respectively through the holes 12,12' in the plates 6,8,10 and beams 2,4. The side connecting plates 10 are bolted together with the beam web 16 therebetween.

Figure 2A:
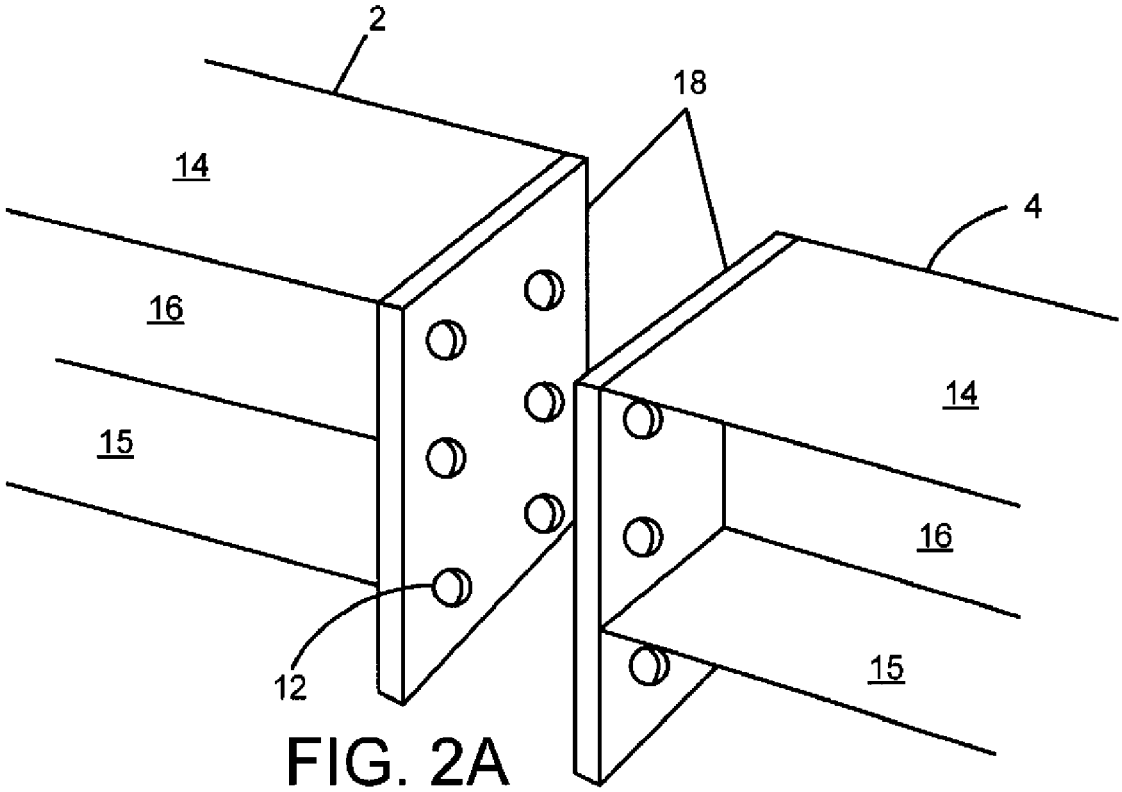
FIG. 2A PRIOR ART
FIGS. 2A-2B show further conventional techniques for connecting the ends of two metal beams together.
Figure 2B:
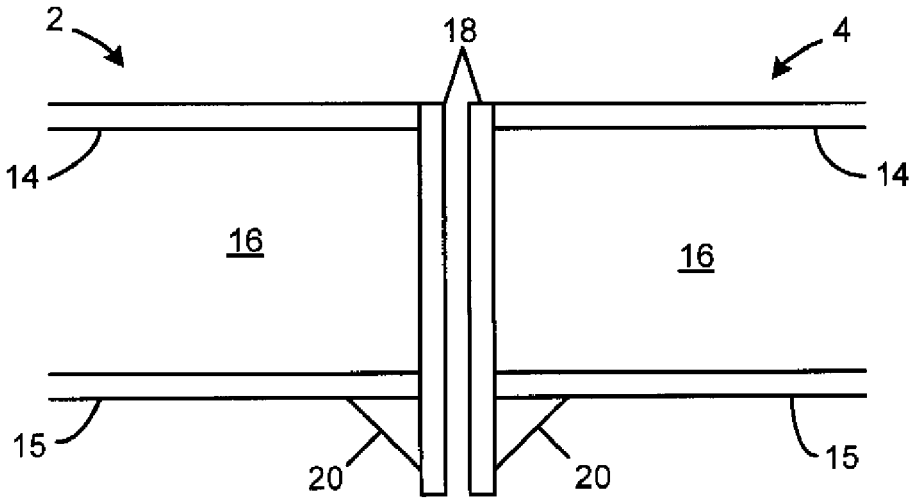

FIGS. 2A-2B show alternative conventional techniques for connecting the ends of two metal beams 2,4 together. Rather than forming holes 12' in the beams as described above in relation to FIGS. 1A-1B, the beams 2,4 may be connected by drilled or punched connecting plates 18 which have been welded to the ends of the beams 2,4 as shown in FIG. 2A. The connecting plates 18 are then bolted together through the holes so as to connect the ends of the two beams 2,4. The connecting plates 18 are arranged to extend below the lower flanges 15 of the beams 2,4 so as to help prevent the beams from pivoting relative to each other about the joint, once they have been connected.

FIG. 2B shows the conventional connecting technique of FIG. 2A with the additional use of stiffener members 20. The stiffener members 20 extend across the corners formed by the lower surfaces of the bottom flanges 15 and the portions of the connecting plates 18 which extend below the bottom flanges 15. The stiffener members 20 further strengthen the joint between the two beams 2,4.

All of the conventional techniques described above require highly skilled labour to accurately design the components and extensive workshop fabrication of the components. These conventional techniques are therefore extremely time consuming and expensive. Further, the connecting plates are difficult to remove and must be re-ordered and re-fabricated in the event of an error.

Figure 3A:
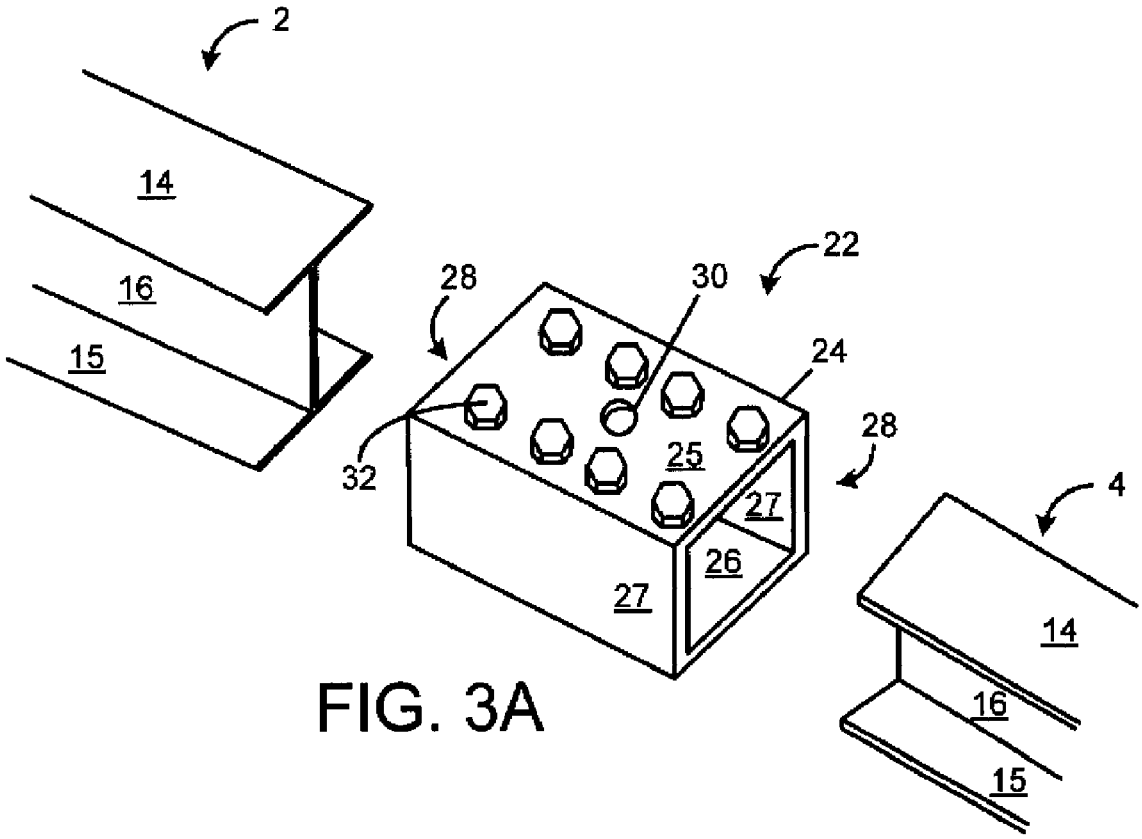
FIGS. 3A-3B show a preferred embodiment of the present invention for connecting the ends of two metal beams together.
Figure 3B:
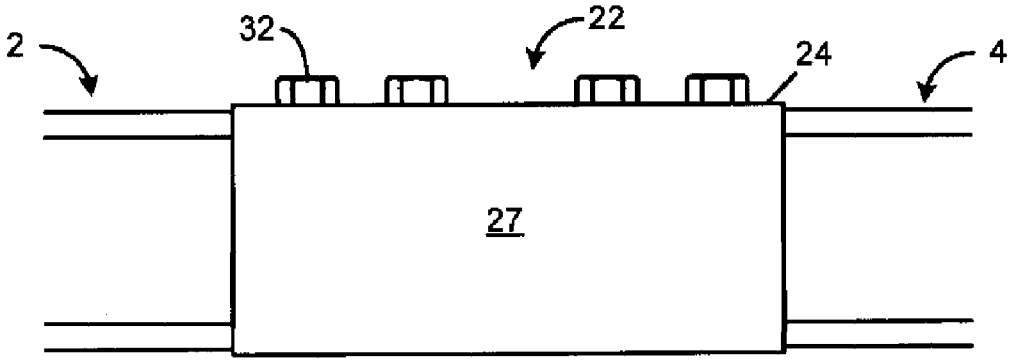

FIGS. 3A-3B show a connector sleeve 22 according to a preferred embodiment of the present invention for connecting the ends of two beams 2,4 together. The sleeve comprises a hollow box 24 manufactured from mild steel. The hollow box 24 has top 25, bottom 26 and side 27 walls and comprises open ends 28 at opposite ends of the box 24. The openings 28 in the end faces of the box 24 and the hollow cross-section through the box 24 are rectangular and are sized and shaped to receive the end portions of two I-shaped beams 2,4 of uniform cross-section. The box is sized and configured such the beams 2,4 can be axially inserted into the openings 28, but such that the beams 2,4 cannot move significantly in the lateral or vertical direction within the box 24. The box 24 has a circular opening 30 located centrally in the top wall 25 for viewing into the box 24.

The box 24 also comprises screw threaded integral bolts 32 which can be screwed through the top wall 25. Each screw threaded bolt 32 is maintained coupled to the top wall 25 of the box 24 by a bolt receiving member which is joined to the upper surface of the top wall 25. The form of the bolt receiving member can be better seen in the embodiment shown in FIG. 5B. Referring back to FIGS. 3A-3B, the bolt receiving member has an internally threaded bore extending therethrough for co-operating with the external screw thread on the bolt 32. The bore of the bolt receiving member is also centred about a hole through the top wall 25 such that the bolt 32 may be tightened to screw through the top wall 25.

In order to connect the two beams 2,4, the connector box 24 is slid axially over the end of a first beam 2 until the end of the upper flange 14 of the first beam 2 can be seen extending across the mid-point of the circular aperture 30. The bolts 32 in the portion of the connector box 24 above the upper flange 14 of the first beam 2 are then tightened so that the bolts 32 screw through the bolt receiving members and through the top wall 25 of the box 24 until the lower surface of the bolts 32 contact the upper surface of the upper flange 14. The bolts 32 are tightened until the pressure is sufficient such that the friction between the lower surfaces of the bolts 32 and the upper surface of the upper flange 14 prevents axial movement of the first beam 2 relative to the box 24 under normal conditions present in the structure during and after its construction. The end of the first beam 2 is then unable to move in any direction relative to the box 24. The end of a second beam 4 is then introduced axially into the open end 28 of the box 24 until the ends of the two beams 2,4 abut one another. This is visually confirmed through the aperture 30 in the top wall 25 of the box 24. At this stage the bolts 32 in the portion of the box 24 above the upper flange 14 of the second beam 4 are tightened so as to engage the second beam 4 in the same manner as described above with respect to the engagement between the bolts 32 and the first beam 2. The two beams 2,4 are then connected in end-to-end relationship and are unable to move relative to each other.

Alternative methods are contemplated wherein the beams 2,4 are inserted into the box 24 so that their ends abut one another and then the box 24 is moved such that the ends of the beams 2,4 extend across the centre of the viewing aperture 30. Alternatively, the connecting box 24 may be slid entirely over the first beam, the two beams 2,4 placed such that their ends abut one another, and then the box 24 slid over the end of the second beam 4 until the ends of the beams 2,4 can be seen extending across the centre of the viewing aperture 30. In both of these alternative methods the box 24 is located so that the ends of the two beams 2,4 can be seen through the viewing aperture 30 prior to tightening all of the bolts 32.

It will be appreciated that the connector sleeve 22 of this embodiment merely requires the use of a spanner and is significantly faster and more simple to use than the conventional techniques described above in relation to FIGS. 1 and 2.

Figure 4A:
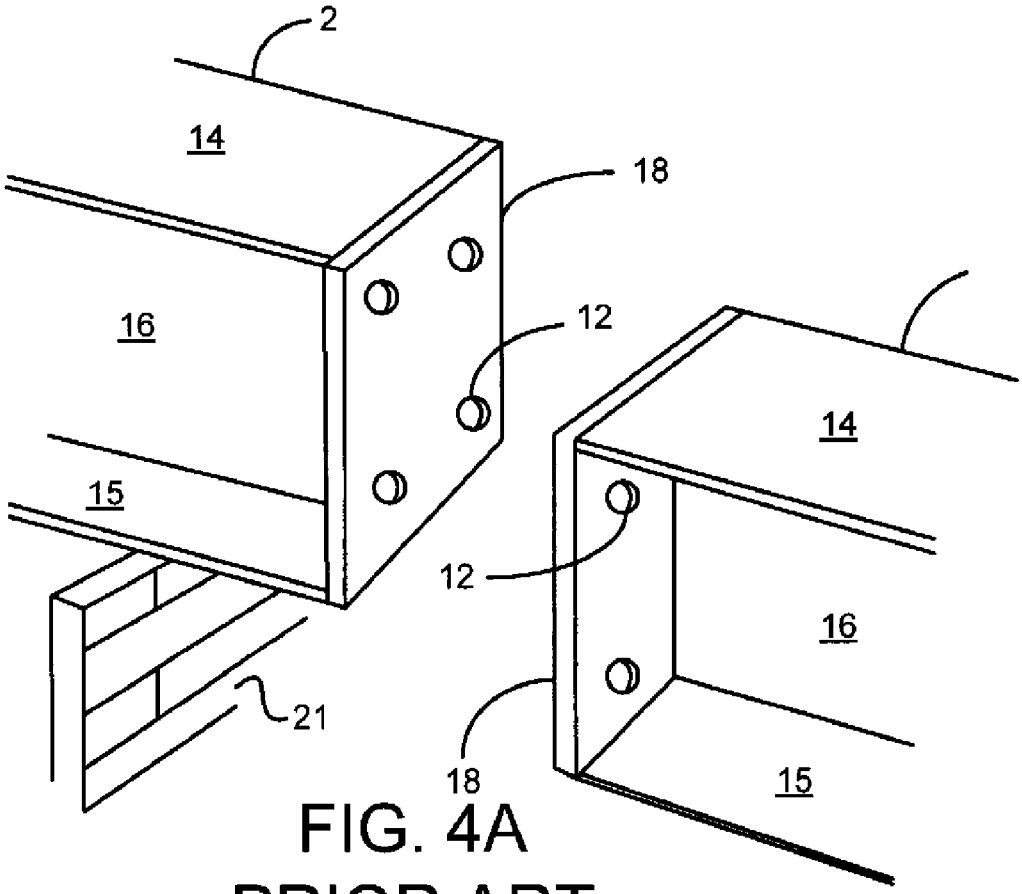
FIG. 4A PRIOR ART
FIGS. 4A-4B show a conventional technique for connecting the ends of two metal beams together when one of the beams extends across a bearing point.
Figure 4B:
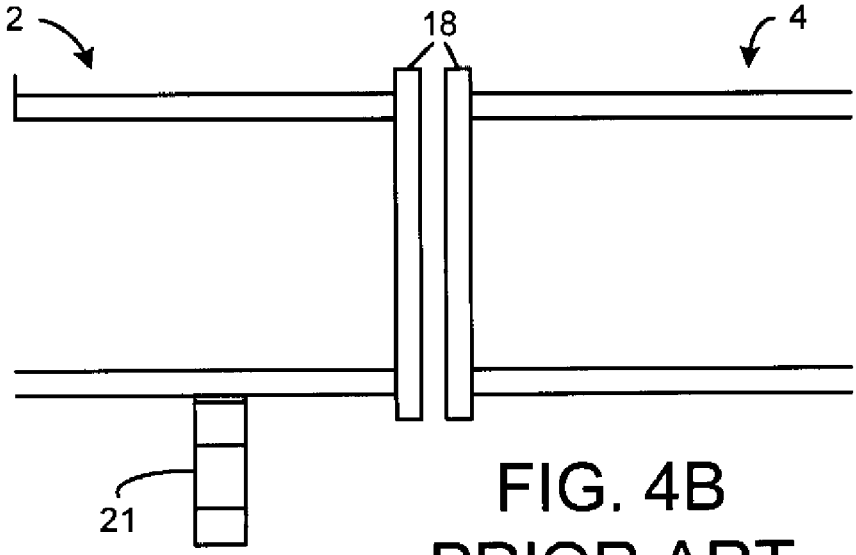
FIG. 4B PRIOR ART

FIGS. 4A-4B show a further conventional technique for joining the ends of two beams 2,4 together, wherein the end of one of the beams 2 is supported by a bearing point, such as a wall 21. The technique for joining the beams 2,4 is similar to that shown and described in relation to FIGS. 2A-2B. However, as the end of one of the beams 2 is very close to the bearing point 21 (typically 100-200 mm from the bearing point) and arranged in cantilever, lower forces are exerted on the connection between the two beams 2,4. Therefore, the connection plates 18 do not need to extend below the beams 2,4 and stiffener members 20 are not required as in the conventional connection techniques shown in FIGS. 2A-2B.

Figure 5B:
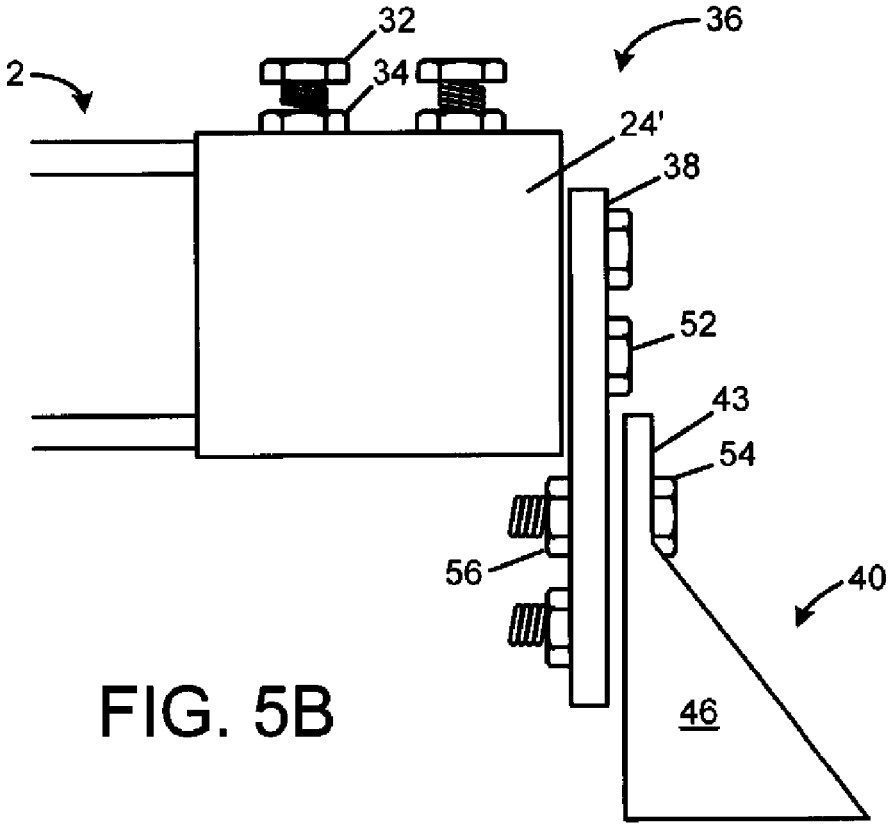
FIGS. 5A-5B show a preferred embodiment of the present invention for connecting the ends of two metal beams together when one of the beams extends across a bearing point.
Figure 5A:
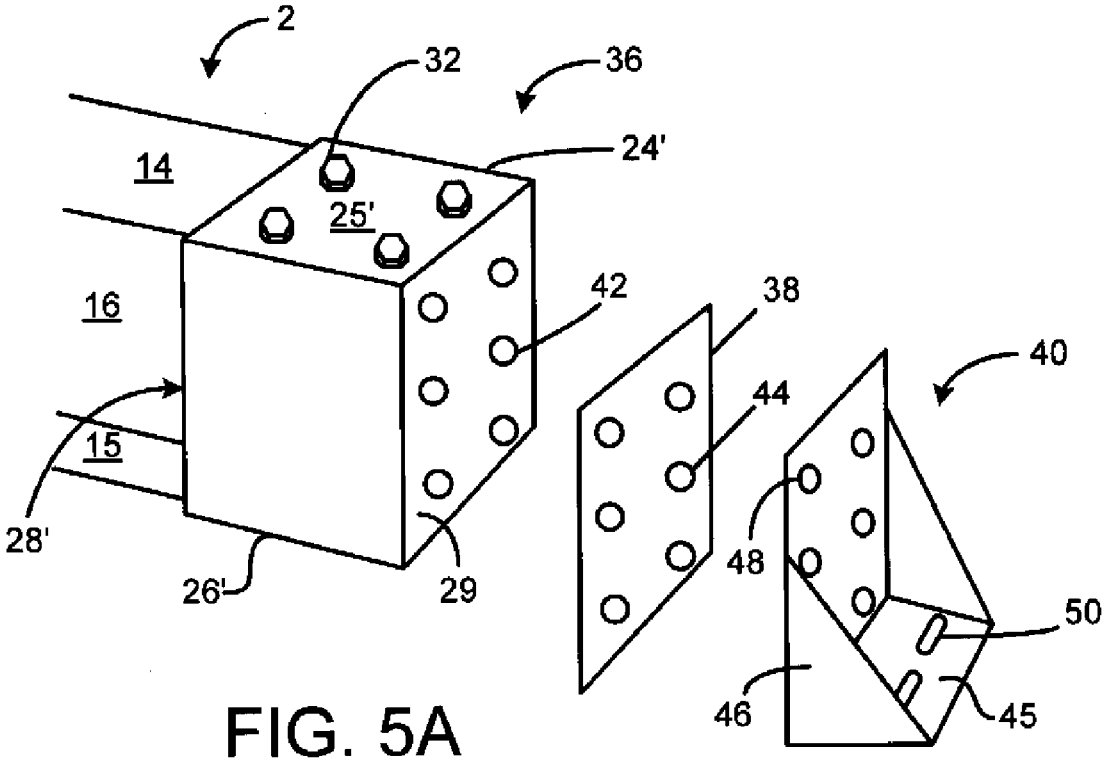

FIGS. 5A-5B show a connection assembly according to a preferred embodiment for connecting two metal beams together in end-to-end relationship. The connection assembly is preferably for use in situations wherein at least one of the beams is supported by a bearing point at or very close to its end which is to be connected to another beam, typically 100-200 mm from the bearing point to the end of the beam.

The connection assembly comprises a connector sleeve 36, an adaptor plate 38 and a beam hanger 40. In use, the connector sleeve 36 is secured to the end of a first beam 2, which is preferably supported at a bearing point close to its free end. The adaptor plate 38 is bolted to the connector box 36 and the beam hanger 40 is bolted to the adaptor plate 38, as is shown in FIG. 5B. The beam hanger 40 receives a second beam (not shown).

The connector sleeve 36 comprises a end box 24' manufactured from mild steel. The end box 24' has top, bottom and side walls. The box further comprises an end wall 29 and an open face 28' opposite to the end wall 29 for receiving the first beam 2. The opening 28' in the end face of the box 24' and the hollow cross-section through the box 24' are rectangular and are sized and shaped to receive the end portion of an I-shaped beam 2 of uniform cross-section. The box 24' is sized and configured such the first beam 2 can be axially inserted into the opening 28', but such that the beam 2 cannot move significantly in the lateral or vertical directions within the box 24'.

The end wall 29 comprises rows of holes 42 for receiving bolts therein. The holes 42 are located in the end wall 29 away from the top and bottom edges and towards the side edges of the end box 24' such that when bolts are passed therethrough they are not obstructed by the top and bottom flanges 14,15 or the web 16 of the I-shaped metal beam 2. Bolt receiving members (similar to the members 34 shown in FIG. 5B) are located on the inside surface of the end wall 29 about the holes 42 in the end wall 29. Each bolt receiving member has an internally threaded bore extending therethrough for co-operating with an external screw thread on a bolt. The bore in each bolt receiving member is centred about a hole 42 in the end wall 29.

The adaptor plate 38 is a metal plate comprising rows of holes 44 which are spaced apart so as to correspond with the spacing of the holes 42 in the end wall 29 of the end box 24'. The adaptor plate 38 is longer than the end wall 29 of the end box 24' and has at least one more additional row of holes 44 than the end wall 29 of the end box 24'. The adaptor plate 38 has a thickness and is configured such that it does not yield or bend significantly when used to couple the end box 24' to the beam hanger 40.

The beam hanger 40 is a metal structure comprising an end wall 43 for connecting it to the adaptor plate 38, a base wall 45 perpendicular and connected to the lower edge of the end wall 43 for supporting a beam placed therein and side walls 46. The end wall 43 comprises a series of holes 48 having a spacing corresponding to the spacing of the holes 44 in the adaptor plate 38. The base wall 45 has two slot-shaped apertures 50, extending in a direction between the side walls 46 and for receiving bolts (not shown). The side walls 46 are perpendicular to the end wall 43 and base wall 45 and join the edges of these two walls together so as to strengthen the beam hanger 40 against the weight of a beam.

In order to connect the two beams together the open end 28' of the end box 24' is slid over a first beam 2 until the inner surface of the end wall 29 abuts the end of the first beam 2. The integral bolts 32 in the end box 24' are then tightened so that the bolts 32 screw through the bolt receiving members 34 and through the top wall 25' of the box 24' until the lower surfaces of the bolts 32 contact the upper surface of the upper flange 14. The bolts 32 are tightened until the pressure is sufficient such that the friction between the lower surfaces of the bolts 32 and the upper surface of the upper flange 14 prevents the axial movement of the first beam 2 relative to the box 24' under normal conditions present in the structure during and after its construction. The end of the first beam 2 is then unable to move in any direction relative to the box 24'.

The adaptor plate 38 is then bolted in face-to-face relationship with the end wall 29 of the end box 24' through the holes 42,44 in the adaptor plate 38 and the end wall 29 of the end box 24'. The adaptor plate 38 and end box 24' are bolted together by introducing externally screw threaded bolts 52 through the adaptor plate 38 and end wall 29 of the end box 36 and screwing them into the bolt receiving members on the inside surface of the end wall 29. The bolt heads prevent the adaptor plate 38 from moving relative to the end wall 29 of the end box 24'. The adaptor plate 38 has more rows of holes 44 than the end wall 29 of the end box 24' and is bolted thereto such that a part of the adaptor plate 38 comprising holes 44 extends below the bottom wall 26' of the end box 24'.

The end wall 43 of the beam hanger 40 is then bolted to the adaptor plate 38 in face-to-face relationship through the holes 48 in the end wall 43 of the beam hanger 40 and the holes 44 in the adaptor plate 38 which are located below the end box 24'. The beam hanger 40 and adaptor plate 38 are bolted together by introducing bolts 54 through the end wall 43 of the beam hanger 40, then through the adaptor plate 38 and then screwing the bolts 54 into bolt receiving members 56. The bolt receiving members 56 co-operate with the bolt heads 54 to prevent the adaptor plate 38 and beam hanger 40 moving relative to each other. The beam hanger 40 is thus connected to the first beam 2 via the adaptor plate 38 and end box 24' as shown in FIG. 5B.

A second beam is then inserted into the beam hanger 40. Adjustable bolts may be provided in the slot-shaped apertures 50 in the base wall 45 of the beam hanger 40 which limit the lateral movement of the second beam in the beam hanger 40. The adjustable bolts may be loosened, moved in the direction between the side walls 46 in the slot-shaped apertures 50 and retightened so as to accommodate different sizes and/or lateral positions of the second beam.

The relative number and location of the holes 42,44,48 in the end box 24', adaptor plate 38 and beam hanger 40 may be varied provided that a sufficient number of holes are provided to secure the three components together whilst supporting the weight of the beams. The relative number and location of the holes 42,44,48 in the end box 24', adaptor plate 38 and beam hanger 40 may be selected such that the beam hanger 40 can be bolted at multiple different vertical or lateral positions relative to the end box 24'. In this manner, a single connection assembly may be used to connect the two beams at several different positions relative to each other.

In an alternative embodiment, the beam hanger 40 is connected to the end box 24' directly, without the use of the adaptor plate 38. The relative number and location of the holes 42,48 in the end walls 29,43 of the end box 24' and beam hanger 40 may be selected such that the two components can be bolted together at several different vertical and lateral positions relative to each other.

In another non-illustrated embodiment, the beam hanger 40 may be an end box corresponding to the end box 24' that is connected to the first beam 2. In this embodiment, the connection assembly is assembled in the same manner as described above in relation to FIGS. 5A-5B except that the beam hanger 40 end box is connected to the adaptor plate 38. More specifically, the end wall of the beam hanger 40 end box is bolted to the adaptor plate 38 in face-to-face relationship through the holes in the end wall of the beam hanger 40 end box and the holes 44 in the adaptor plate 38. The beam hanger 40 end box and adaptor plate 38 are bolted together by introducing bolts 54 through the end wall of the beam hanger 40 end box, then through the adaptor plate 38 and then screwing the bolts 54 into bolt receiving members 56.

A second beam may then be inserted into the beam hanger 40 end box through its opening. The integral bolts in the beam hanger 40 end box are then tightened so that the second beam is clamped within the end box and unable to move.

A further non-illustrated embodiment is contemplated wherein the connector sleeve 36 end box 24' is connected to the beam hanger 40 end box directly and without the use of the adaptor plate 38. In this embodiment the two end boxes may be connected such that their end walls totally overlap each other and such that the longitudinal axes of the first and second beams are aligned.

Figure 6A:
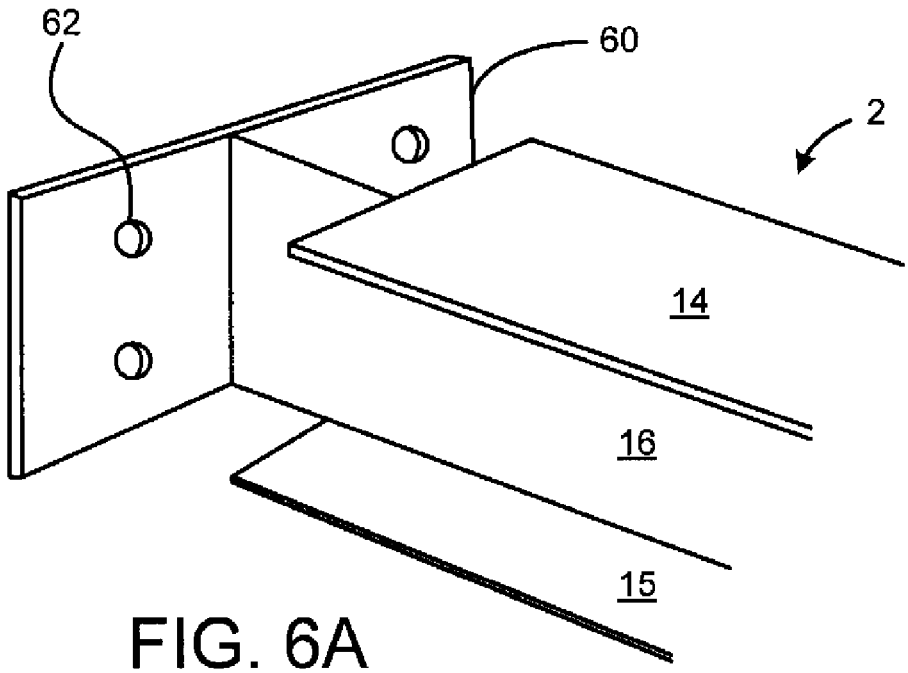
FIG. 6A PRIOR ART
FIGS. 6A-6B show a conventional technique for connecting two metal beams together at right angles to each other.
Figure 6B:
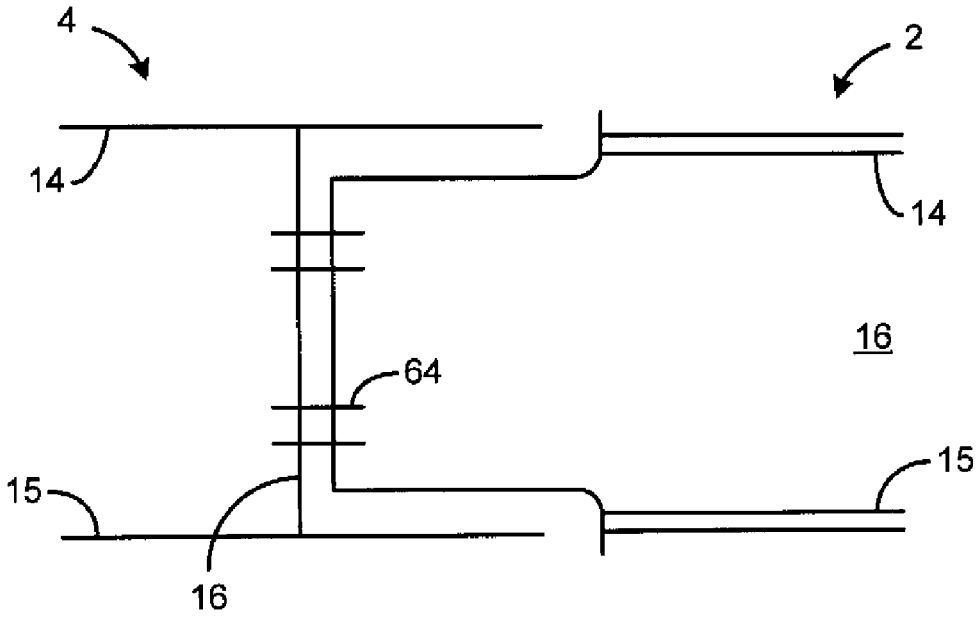
FIG. 6B PRIOR ART

FIGS. 6A-6B show a conventional technique for connecting two I-shaped beams at a 90° angle with respect to each other. FIG. 6A shows a perspective view of the first beam 2 with its attached connecting plate 60 prior to the connection to the second beam 4. FIG. 6B shows a side view of the two beams 2,4 after they have been connected at right angles to each other.

Referring to FIG. 6A, firstly the top and bottom flanges 14,15 of the first beam 2 are cut back so that the web 16 of the first beam 2 at the cut back portion can fitted between the top and bottom flanges 14,15 of the second beam 4 so as to approach the web 16 of the second beam 4. A drilled plate 60 is then welded onto the end of the web 16 of the first beam 2. The drilled plate 60 and web 16 of the first beam 2 are then moved between the flanges 14,15 of the second beam 4 until the plate 60 meets the web 16 of the second beam 4 at the location where the two beams 2,4 are to be connected together. The drilled plate 60 is then welded to the web 16 of the second beam 4 and holes are drilled through the web 16 of the second beam at locations corresponding to the holes 62 in the drilled plate 60. The web 16 of the second beam 4 is then bolted to the drilled plate 60 by passing bolts 64 through the holes in the second beam 4 and the drilled plate 60 so as to securely connect the two beams 2,4 at right angles to each other.

Again, this conventional technique relies upon accurate design and measurements by a structural engineer and extensive workshop fabrication. Once the connection has been made there is no scope for adjustment and should any errors have occurred then the connection will need to be entirely refabricated.

Figure 7C:
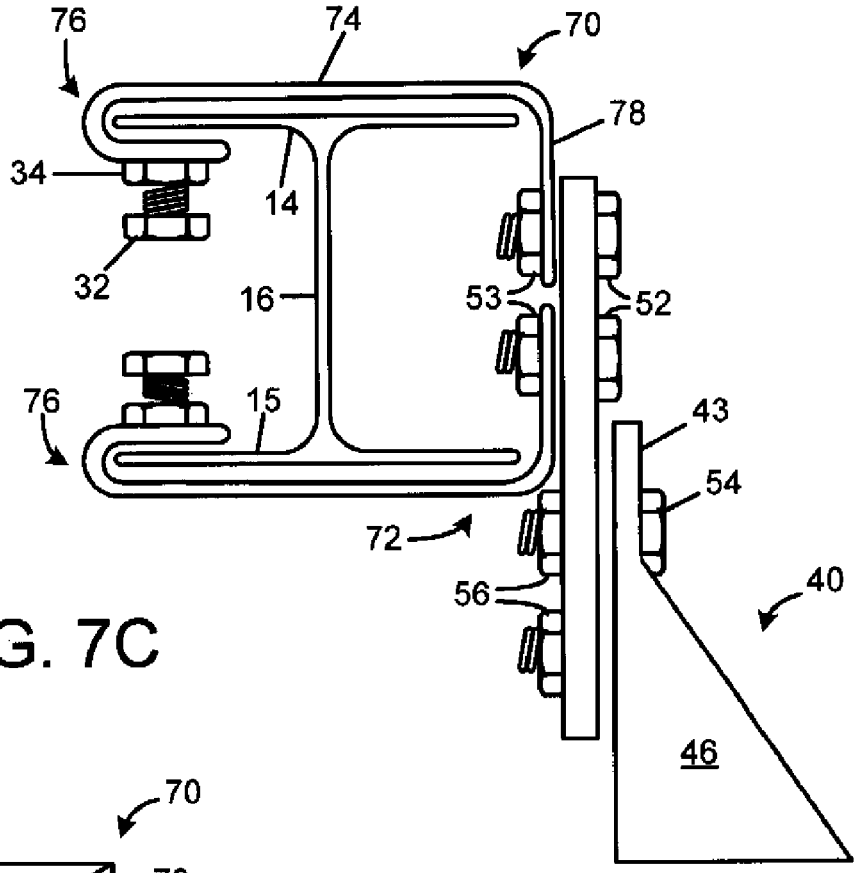
FIGS. 7A-7C show a preferred embodiment of the present invention for connecting two metal beams together at right angles to each other.
Figure 7A:
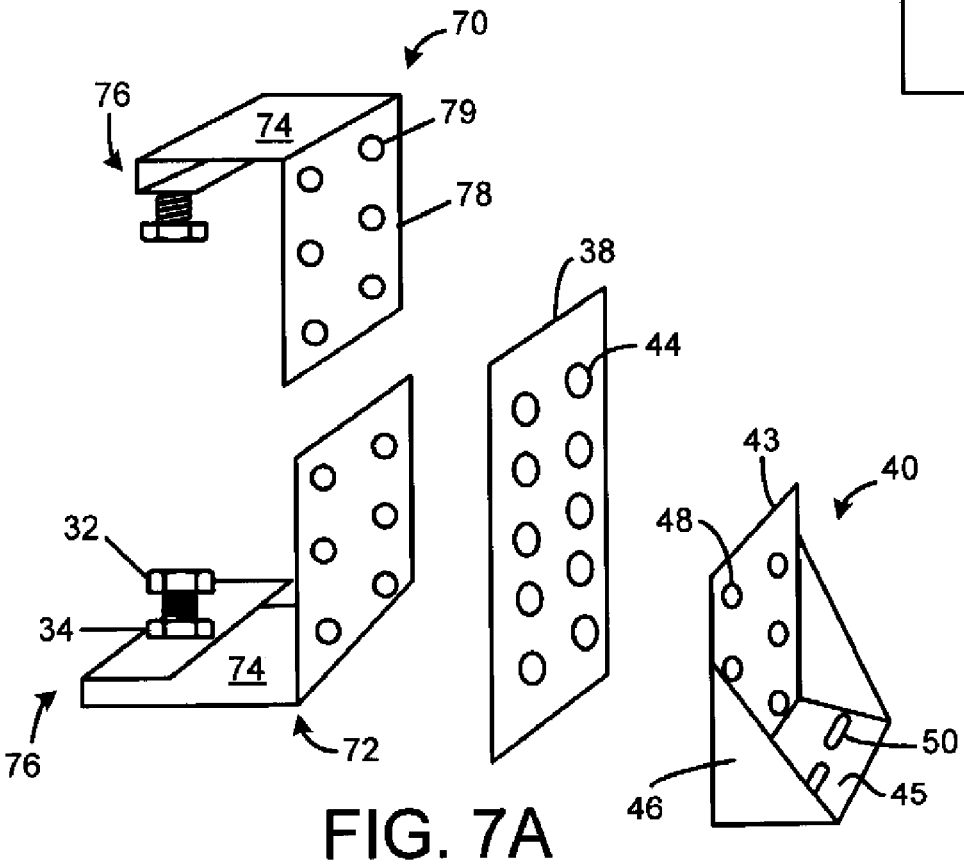
Figure 7B:
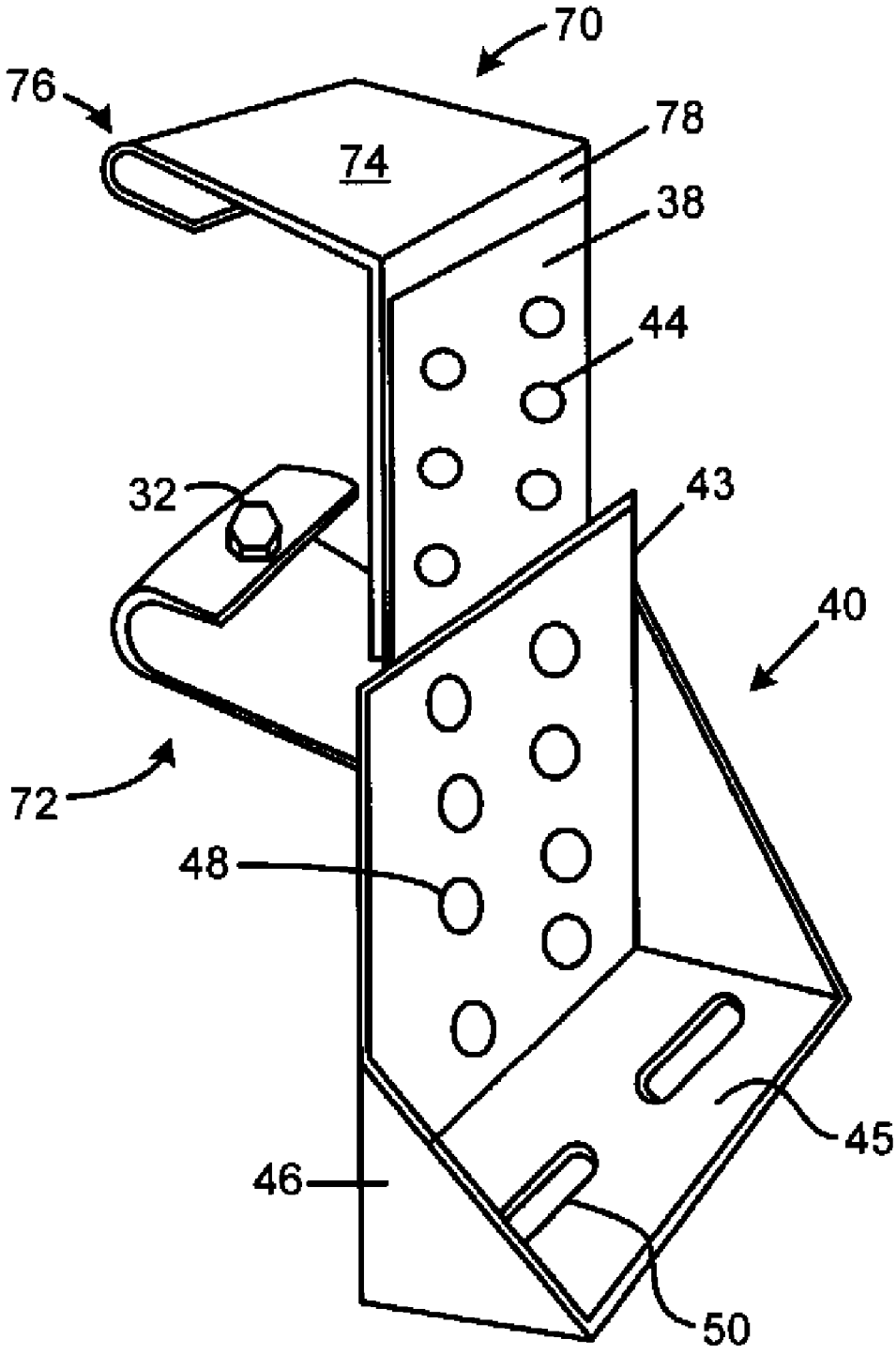

FIGS. 7A-7C show a connection assembly according to a preferred embodiment of the present invention for connecting two metal beams together at right angles to each other. The assembly comprises upper and lower connector sleeves 70,72, an adaptor plate 38 and a beam hanger 40.

The components are substantially the same as those described above in relation to FIGS. 5A-5B, except that the end box 24' is replaced by upper and lower connector sleeves 70,72 so that the beam hanger 40 can be hung from the side of the first beam 2, rather than from the end of the beam 2.

The upper connector sleeve 70 comprises an upper wall 74 for contacting the upper surface of the upper flange 14 of a first beam 2. The upper wall 74 is sized and configured to extend across the entire width of the upper flange 14 and has a lipped portion 76 at one end thereof which is sized and configured such that it can extend around an outer edge of the upper flange 14 and part way under the lower surface of the upper flange 14. In other words, the lipped portion 76 forms opposing walls which receive the outer portion of the upper flange 14 therebetween.

The lipped portion 76 is provided with at least one bolt 32 and bolt receiving member 34 on the lower surface of the part of the lipped portion 76 that extends under the upper flange 14. The bolt receiving member 34 has an internally threaded bore extending therethrough for co-operating with an external screw thread on the bolt 32. The bore in the bolt receiving member 34 is centred about a hole through the lipped portion 76 such that the bolt 32 may be screwed through the lipped portion 76.

The connector sleeve 70 further comprises an apertured end wall 78 arranged at the opposite end of the upper wall 74 to the lipped portion 76. The apertured end wall 78 is arranged and configured to hang down along the side of the first beam 2 perpendicular to the upper flange 14. The apertured end wall 78 is sized so as to extend approximately half way between the flanges 14,15 of the first beam 2.

The lower connecting sleeve 72 is identical to the upper connecting sleeve 70, although it is used for connection to the lower flange 15 of the first beam 2.

The adaptor plate 38 is a metal plate comprising rows of holes 44 which are spaced apart so as to correspond with the spacing of the holes 79 in the end walls 78 of the connector sleeves 70,72. The adaptor plate 38 is longer than the end wall 78 of each connector sleeve 70,72 and has at least one more additional row of holes 44 than each end wall 78. The adaptor plate 38 has a thickness and configuration such that it does not yield or bend significantly when used to couple the connector sleeves 70,72 to the beam hanger 40.

The beam hanger 40 is a metal structure comprising an end wall 43 for connecting it to the adaptor plate 38, a base wall 45 arranged perpendicular and connected to the lower edge of the end wall 43 for supporting a beam placed therein and side walls 46. The end wall 43 comprises a series of holes 48 having a spacing corresponding to the spacing of the holes 44 in the adaptor plate 38. The base wall 45 has two slot-shaped apertures 50 extending in a direction between the side walls 46 and for receiving bolts. The side walls 46 are perpendicular to the end wall 43 and base wall 45 and join the edges of these two walls together so as to strengthen the beam hanger 40 against the weight of a beam.

In order to connect the two beams, the upper and lower connector sleeves 70,72 are slid onto the end of the first beam 2 such that the lateral edges of one side of the flanges 14,15 are received inside of the lipped portions 76 and the apertured end walls 78 extend adjacent to the lateral edges of the other side of the flanges 14,15. Alternatively, the lipped portions 76 of the connector sleeves 70,72 may be hooked over the beam flanges 14,15 so as to arrange the sleeves 70,72 on the beam 2. The connector sleeves 70,72 are then moved to the desired position on the first beam 2 at which the beam hanger 40 and second beam are to be connected. The bolts 32 in the lipped portions 76 are then tightened so that the ends of the bolts 32 engage the vertically inner surfaces of the upper and lower flanges 14,15 with sufficient pressure such that the friction between the bolts 32 and the flanges 14,15 prevents the connector sleeves 70,72 from moving relative to the first beam 2. The lipped portions 76 must be strong enough and configured such that they do not yield significantly and maintain the bolts 32 in contact with the first beam 2 when the bolts 32 are tightened, and when the two beams are finally connected.

The adaptor plate 38 is then bolted in face-to-face relationship with the end walls 78 of the connector sleeves 70,72 through the holes 44,79 in the adaptor plate 38 and the end walls 78. The adaptor plate 38 and connector sleeves 70,72 are bolted together by introducing externally screw threaded bolts 52 through the adaptor plate 38 and end walls 78 of the connector sleeves 70,72 and screwing them into the bolt receiving members 53 located on the inside surface of the end walls 78. The bolt heads 52 prevent the adaptor plate 38 from moving relative to the end walls 78. The adaptor plate 38 has a length such that it can be bolted to both connector sleeves 70,72 with part of the adaptor plate 38 comprising holes 44 extending below the lower connector sleeve 72.

The end wall 43 of the beam hanger 40 is then bolted to the adaptor plate 38 in face-to-face relationship through the holes 48 in the end wall 43 of the beam hanger 40 and the holes 44 in the adaptor plate 38 which are located below the lower connector sleeve 72. The beam hanger 40 and adaptor plate 38 are bolted together by introducing bolts 54 through the end wall 43 of the beam hanger 40, then through the adaptor plate 38 and then screwing the bolts 54 into bolt receiving members 56. The bolt receiving members 56 co-operate with the bolt heads 54 to prevent the adaptor plate 38 and beam hanger 40 moving relative to each other.

The beam hanger 40 is then connected to the first beam 2 via the adaptor plate 38 and connector sleeves 70,72 as shown in FIG. 7C.

A second beam (not shown) is then inserted into the beam hanger 40. Adjustable bolts may be provided in the slot-shaped apertures 50 in the base wall 45 of the beam hanger 40 which limit the lateral movement of the second beam in the beam hanger 40. The adjustable bolts may be loosened, moved in the direction between the side walls 46 in the slot-shaped apertures 50 and retightened so as to accommodate different sizes and/or lateral positions of the second beam.

The relative number and location of the holes 78,44,48 in the connector sleeves 70,72, adaptor plate 38 and beam hanger 40 may be varied provided that a sufficient number of holes are provided to secure these components together whilst supporting the weight of the beams. The relative number and location of the holes 78,44,48 in the connector sleeves 70,72, adaptor plate 38 and beam hanger 40 may be selected such that the beam hanger 40 can be bolted at multiple different vertical and/or lateral positions relative to the connector sleeves 70,72. In this manner, a single connection assembly may be used to connect the two beams at several different positions relative to each other.

In an alternative embodiment, the beam hanger 40 is connected to the connector sleeves 70,72 directly, without the use of the adaptor plate 38. The length of the end wall 43 of the beam hanger 40 and relative number and location of the holes 79,48 in the end walls 78 of the connector sleeves 70,72 and beam hanger 40 may be selected such that these components can be bolted together at several different vertical and/or lateral positions relative to each other.

In another non-illustrated embodiment the connector sleeves 70,72 may be replaced by a single connector sleeve rather than two separate sleeves. In this embodiment, the apertured end walls 78 shown in FIG. 7A would instead be a single apertured wall sized so as to extend continuously between the upper and lower walls 74 of the connector sleeve.

Figure 8A:
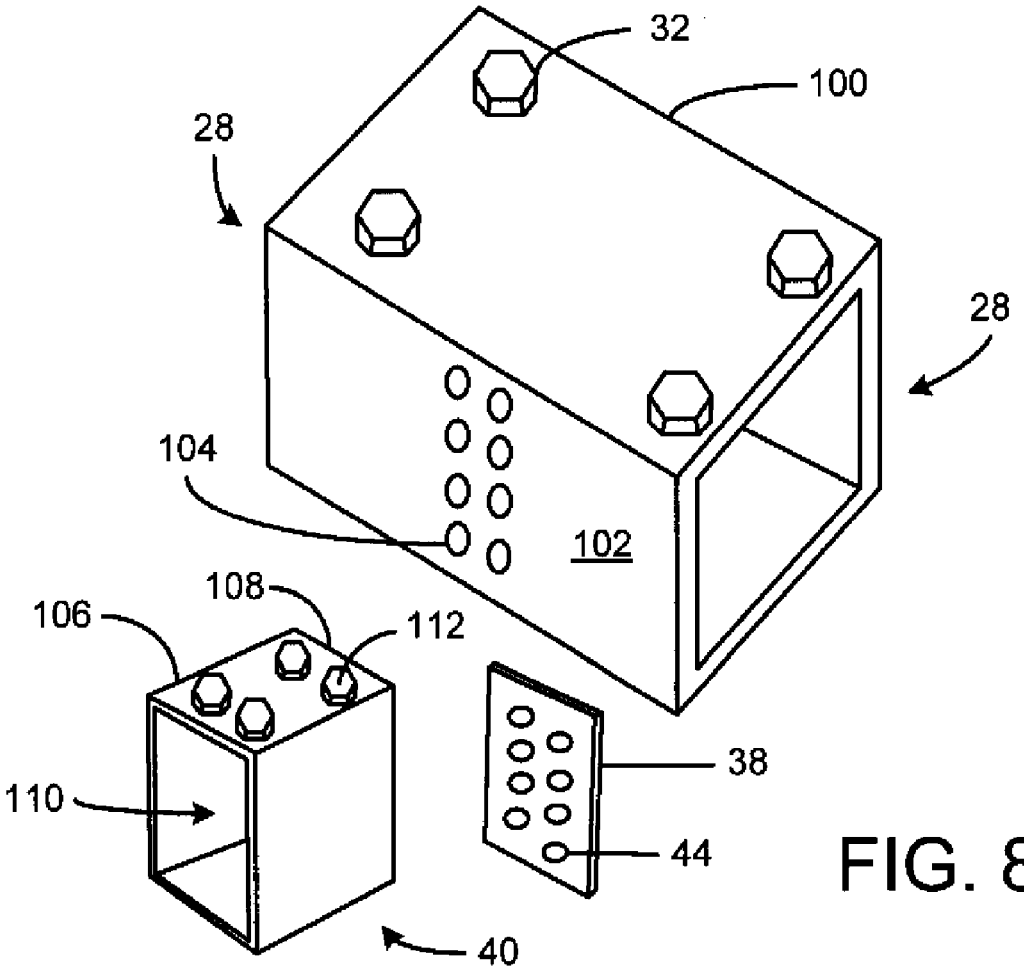
FIGS. 8A-8B show another preferred embodiment for connecting two metal beams together at right angles to each other.
Figure 8B:
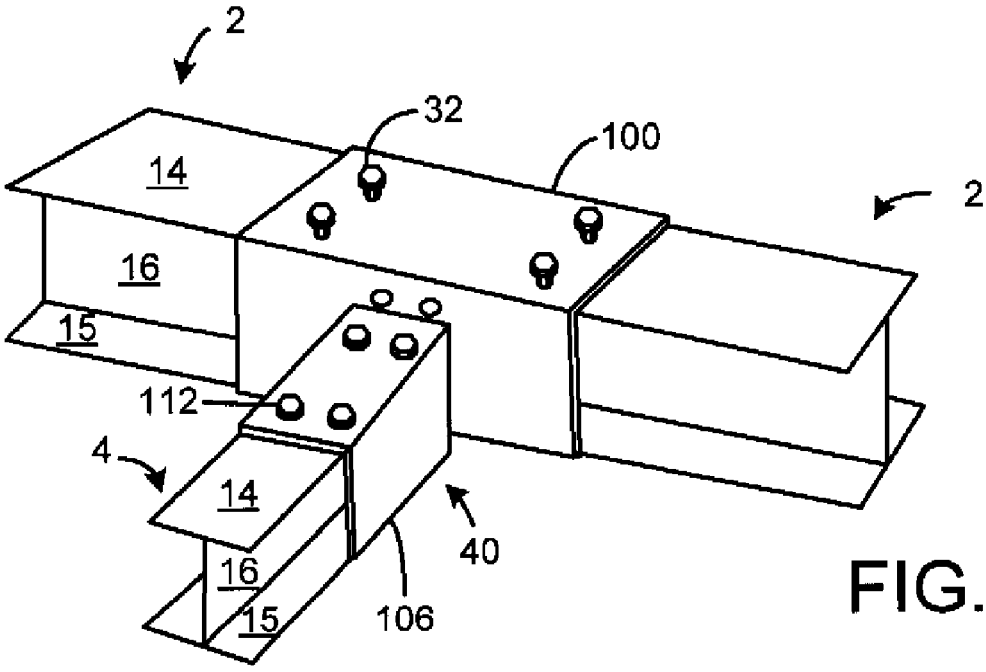

FIGS. 8A-8B show another connection assembly according to a preferred embodiment of the present invention for connecting two metal beams together at right angles to each other. The assembly comprises a connector sleeve 100, an adaptor plate 38 and a beam hanger 40. In use, the connector sleeve 100 is slid onto a first beam 2, the adaptor plate 38 is bolted to the connector sleeve 100 and the beam hanger 40 is bolted to the adaptor plate 38. The beam hanger 40 receives a second beam 4 at a right angle to the first beam 2.

The connector sleeve 100 of this embodiment is substantially the same as the connector sleeve 24 described above in relation to FIGS. 3A-3B, except that the connector sleeve 100 comprises an apertured side wall 102. Also, the connector sleeve 100 may have fewer integral bolts 32 as it clamps to only the first beam 2, rather than both the first 2 and second 4 beams.

The side wall 102 comprises rows of holes 104 for receiving bolts therein. The holes are located in the side wall 102 away from the top and bottom edges such that when bolts are passed therethrough they are not obstructed by the top and bottom flanges 14,15 of the I-shaped metal beam 2. Bolt receiving members (similar to the members 34 shown in FIG. 5B) may be located on the inside surface of the side wall 102 about the holes 104 in the side wall 102. Each bolt receiving member has an internally threaded bore extending therethrough for co-operating with an external screw thread on a bolted. The bore in each bolt receiving member is centred about a hole 104 in the side wall 102.

The adaptor plate 38 is a metal plate comprising rows of holes 44 which are spaced apart so as to correspond with the spacing of the holes 104 in the side wall 102 of the connector sleeve 100. The adaptor plate 38 has a thickness and is configured such that it does not yield or bend significantly when used to couple the connector sleeve 100 to the beam hanger 40.

The beam hanger 40 in this embodiment is an end box 106. The end box 106 has top, bottom and side walls. The end box 106 further comprises an end wall 108 and an open face 110 opposite to the end wall 108 for receiving the second beam 4. The opening in the end face 110 of the end box 106 and the hollow cross-section through the end box 106 are rectangular and are sized and shaped to receive the end portion of an I-shaped beam 4 of uniform cross-section. The end box 106 is sized and configured such the second beam 4 can be axially inserted into the opening 110, but such that the beam 4 cannot move significantly in the lateral or vertical directions within the end box 106.

The end wall 108 of the end box 106 comprises rows of holes (not shown) for receiving bolts therein. The holes are located in the end wall 108 away from the top and bottom edges and towards the side edges of the end box 106 such that when bolts are passed therethrough they do not obstruct the top and bottom flanges 14,15 or the web 16 of the I-shaped metal beam 4.

In order to connect the two beams 2,4 together the connector sleeve 100 is slid over a first beam 2 until it is in the desired position. The integral bolts 32 in the connector sleeve 100 are then tightened so that the bolts 32 screw through the bolt receiving members 34 and through the top wall of the sleeve 100 until the lower surfaces of the bolts 32 contact the upper surface of the upper flange 14 of the first beam 2. The bolts 32 are tightened until the first beam 2 is prevented from moving relative to the sleeve 100.

The adaptor plate 38 is then bolted in face-to-face relationship with the side wall 102 of the connector sleeve 100 through the holes 44,104 in the adaptor plate 38 and the side wall 102 of the sleeve 100. The adaptor plate 38 and sleeve 100 are bolted together by introducing externally screw threaded bolts through the adaptor plate 38 and side wall 102 of the connector sleeve 100 and screwing them into the bolt receiving members on the inside surface of the side wall 100. The bolt heads prevent the adaptor plate 38 from moving relative to the side wall 102 of the connector sleeve 100. The adaptor plate 38 is bolted to the side wall 102 such that a part of the adaptor plate 38 comprising holes 44 extends below the bottom wall of the connector sleeve 100.

The end wall 108 of the end box 106 is then bolted to the adaptor plate 38 in face-to-face relationship through the holes in the end wall 108 of the end box 106 and the holes 44 in the adaptor plate 38. The end box 106 and adaptor plate 38 are bolted together by introducing bolts through the end wall 43 of the end box 106, then through the adaptor plate 38 and then screwing the bolts into bolt receiving members. The bolt receiving members co-operate with the bolt heads to prevent the adaptor plate 38 and end box 106 moving relative to each other. The end box 106 is thus connected to the first beam 2 via the adaptor plate 38 and connector sleeve 100.

A second beam 4 is then inserted into the end box 106 and the integral bolts 112 on the end box 106 are tightened so as to clamp the second beam 4 within the end box 106.

The relative number and location of the holes 44,104 in the connector sleeve 100, adaptor plate 38 and end box 106 may be varied provided that a sufficient number of holes are provided to secure the three components together whilst supporting the weight of the beams 2,4. The relative number and location of the holes 44,104 in the connector sleeve 100, adaptor plate 38 and end box 106 may be selected such that the end box 106 can be bolted at multiple different vertical or lateral positions relative to the connector sleeve 100.

In this manner, a single connection assembly may be used to connect the two beams 2,4 at several different positions relative to each other.

In an alternative embodiment, shown in FIG. 8B the end box 106 is connected to the connector sleeve 100 directly, without the use of the adaptor plate 38. The relative number and location of the holes 104 in the side wall 102 of the connector sleeve 100 and the end wall of the end box 106 may be selected such that the two components 100,106 can be bolted together at several different vertical and lateral positions relative to each other.

The connection assemblies of these embodiments allow for simple right-angled connection of the beams 2,4 without the use of highly skilled labour and can be easily removed and relocated in the event of an error.

Figure 9A:
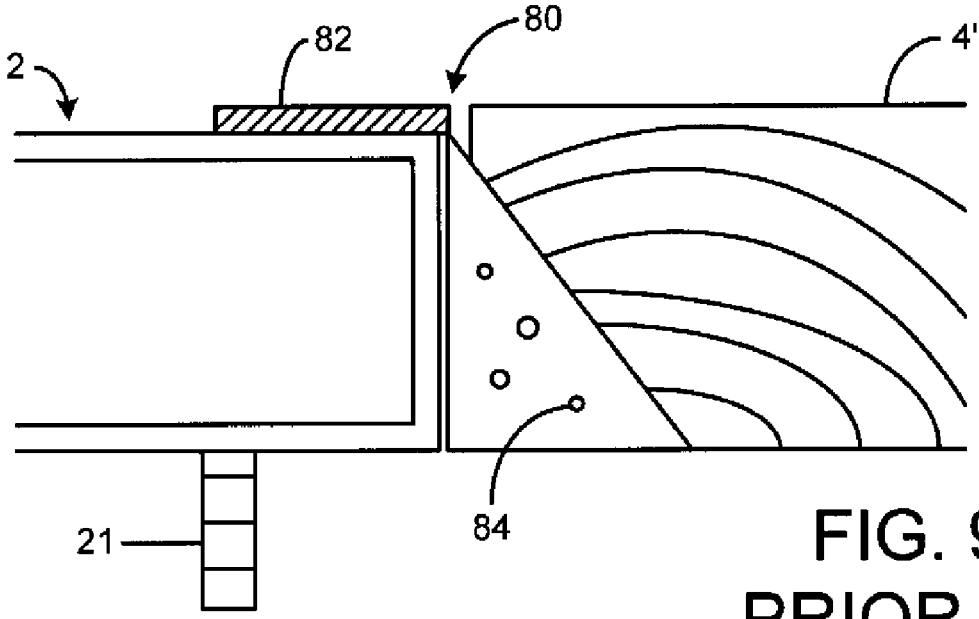
FIG. 9A PRIOR ART
FIGS. 9A-9B show a conventional technique for connecting the end of a metal beam to the end of a timber beam.
Figure 9B:
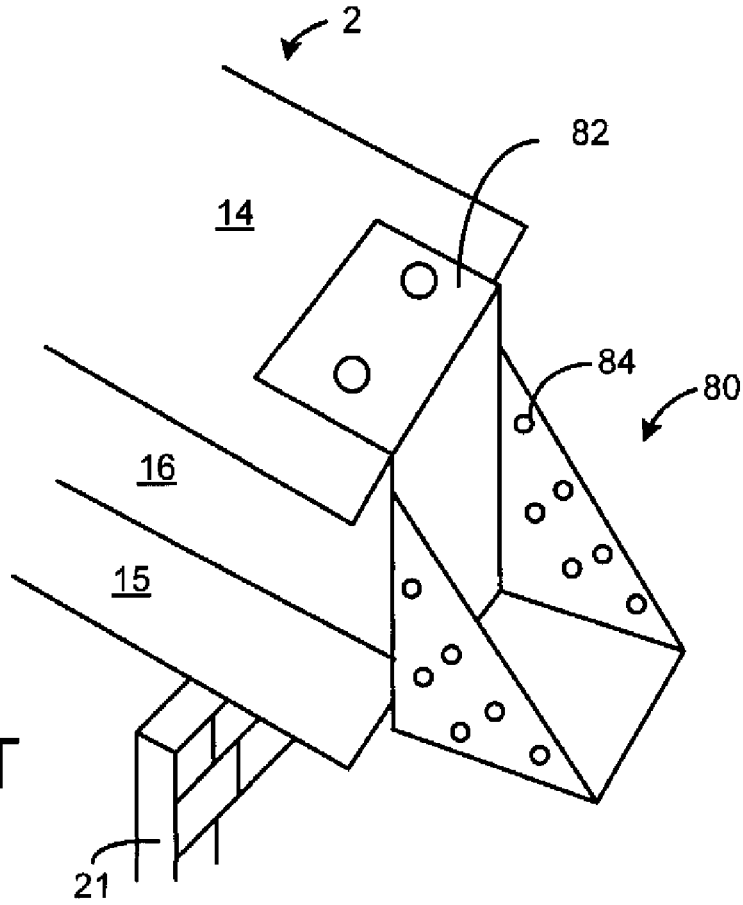
FIG. 9B PRIOR ART

FIGS. 9A-9B show side and perspective views respectively of a conventional technique for connecting the end of a timber beam to the end of a metal beam, wherein the metal beam is arranged in cantilever and supported by a bearing point 21 near its end. A beam hanger 80 is welded to the upper flange 14 of the metal beam 2 via a connector plate 82. The connector plate 82 and upper flange 14 are then drilled through and bolted together. A timber beam 4' is then inserted into the beam hanger 80 and is nailed in place through apertures 84 in the side walls of the beam hanger 80.

Obviously, a significant amount of labour is required to connect the metal beam and the beam hanger and once the connection is made it cannot be easily removed if a mistake has been made.

Figure 10A:
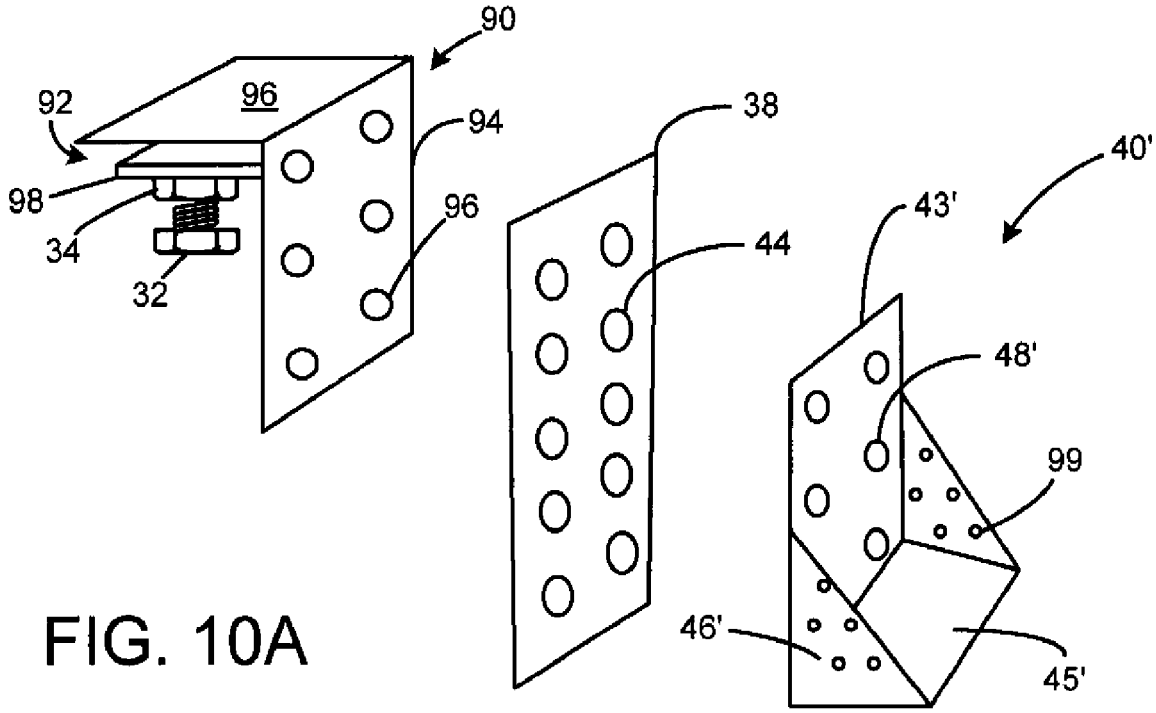
FIGS. 10A-10B show a preferred embodiment of the present invention for connecting the end of a metal beam to the end of a timber beam.
Figure 10B:
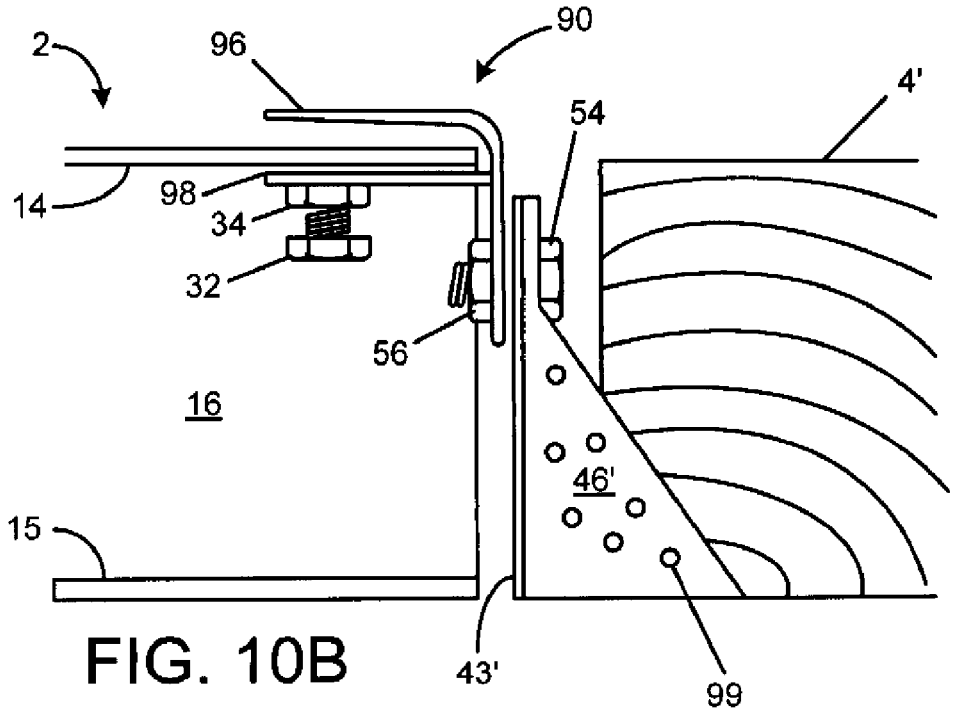

FIGS. 10A-10B show a preferred embodiment of the present invention for connecting a metal beam 2 and a timber beam 4', wherein the metal beam 2 crosses a bearing point near its end to be connected and is able to support the timber beam 4' by way of its cantilever status.

The connection assembly comprises a connector sleeve 90, an adaptor plate 38 and a beam hanger 40'. The components are similar to those described above in relation to FIGS. 7A-7C. The main difference between these embodiments is that the connector sleeves 70,72 of FIGS. 7A-7C are replaced by a different type of connector sleeve 90 for connecting the two beams 2,4' in end-to-end relationship, rather than at right angles to each other.

The connector sleeve 90 comprises an apertured end wall 94 and a beam receiving portion 92 for receiving the axial end portion of a metal beam 2. The beam receiving portion 92 has two opposing walls formed by an upper wall 96 for mounting over and contacting the outer surface of the upper flange 14 of the first beam 2 and a lower wall 98 for mounting under the inner surface of the upper flange 14. The upper and lower walls 96,98 of the beam receiving portion 92 are sized and shaped so as to extend across the entire width of the upper flange 14 and are spaced apart so as to be slidable over the upper flange 14 without the receiving portion 92 being able to move significantly in a direction perpendicular to the flange 14. The lower wall 98 of the beam receiving portion 92 is separated into two laterally spaced parts (not shown) so that it can receive the web 16 of the I-shaped metal beam 2 between the laterally spaced parts.

The lower wall 98 is provided with at least one bolt 32 and bolt receiving member 34 located on the surface facing away from the upper wall 96. The bolt receiving member 34 has an internally threaded bore extending therethrough for co-operating with an external screw thread on the bolt 32. The bore in the bolt receiving member 34 is centred about a hole through the lower wall 98 of the connector sleeve 90 so that the bolt 32 can be screwed through the lower wall 98.

In order to connect the two beams 2,4', the connector sleeve 90 is slid onto the end of the metal beam 2 so as to receive the upper flange 14 between the upper and lower walls 96,98 of the receiving portion 92.

A portion of the beam web 16 is received between the laterally spaced parts of the lower wall 98. The connector sleeve 90 is slid onto the beam 2 until the end of the beam 2 abuts the apertured end wall 94 of the connector sleeve 90. The bolts 32 in the lower wall 98 are then tightened so that the ends of the bolts 32 engage the inner surface of the upper flange 14 with sufficient pressure to prevent the connector sleeve 90 moving relative to the metal beam 2. The receiving portion 92 must be strong enough and configured to maintain the bolts 32 in contact with the metal beam 2 when the bolts 32 are tightened and when the two beams 2,4' are finally connected.

The adaptor plate 38 is then bolted in face-to-face relationship with the end wall 94 of the connector sleeve 90 through the holes 44,96 in the adaptor plate 38 and the end wall 94. The adaptor plate 38 and connector sleeve 90 are bolted together by introducing externally screw threaded bolts through holes 44,96 in the adaptor plate 38 and end wall 94 of the connector sleeve 90 and screwing them into the bolt receiving members 56 on the inside surface of the end wall 94.

The bolt heads prevent the adaptor plate 38 from moving relative to the end wall 94. The adaptor plate 38 has a length such that it can be bolted to the connector sleeve 90 with part of the adaptor plate 38 comprising holes 44 extending below the connector sleeve 90.

The end wall 43' of the beam hanger 40' is then bolted to the adaptor plate 38 in face-to-face relationship through the holes 48' in the end wall 43' of the beam hanger 40' and the holes 44 in the adaptor plate 38 which are located below the connector sleeve 90. The beam hanger 40' and adaptor plate 38 are bolted together by introducing bolts through the end wall 43' of the beam hanger 40', then through the adaptor plate 38 and then screwing the bolts into bolt receiving members (not shown) on the adaptor plate 38. The bolt receiving members co-operate with the bolt heads to prevent the adaptor plate 38 and beam hanger 40' moving relative to each other.

The beam hanger 40' is then connected to the first beam 2 via the adaptor plate 38 and connector sleeve 90.

The timber beam 4' is then inserted into the beam hanger 40' and is nailed in place through the apertures 99 in the side walls 46' of the beam hanger 40'.

The relative number and location of the holes 96,44,48' in the connector sleeve 90, adaptor plate 38 and beam hanger 40' may be varied as long as a sufficient number of holes are provided to secure the these components together whilst supporting the weight of the beams. The relative number and location of the holes 96,44,48' in the connector sleeve 90, adaptor plate 38 and beam hanger 40' may be selected such that the beam hanger 40' can be bolted at multiple different vertical and/or lateral positions relative to the connector sleeve 90. In this manner, a single connection assembly may be used to connect the two beams 2,4' at several different positions relative to each other.

In an alternative embodiment, shown in FIG. 10B, the beam hanger 40' is connected to the connector sleeve 90 directly, without the use of the adaptor plate 38. The length of the end wall 43' of the beam hanger 40' and the relative number and location of the holes 96,48' in the end wall 94 of the connector sleeve 90 and beam hanger 40' may be selected such that these components can be bolted together at several different vertical and/or lateral positions relative to each other.

In another, non-illustrated embodiment two of the connector sleeves shown in FIG. 10A may be provided for engaging the ends of the upper and lower flanges 14,15 in a similar manner to the embodiment shown in FIGS. 7A-7C, except wherein the end walls 94 of the connector sleeves 90 extend adjacent the end face of the first beam 2 rather than along the side of the first beam 2. Alternatively, a single connector sleeve may be provided having two receiving members 92 for engaging the upper and lower flanges 14,15 and a single apertured end wall 94 extending therebetween.

Figure 11A:
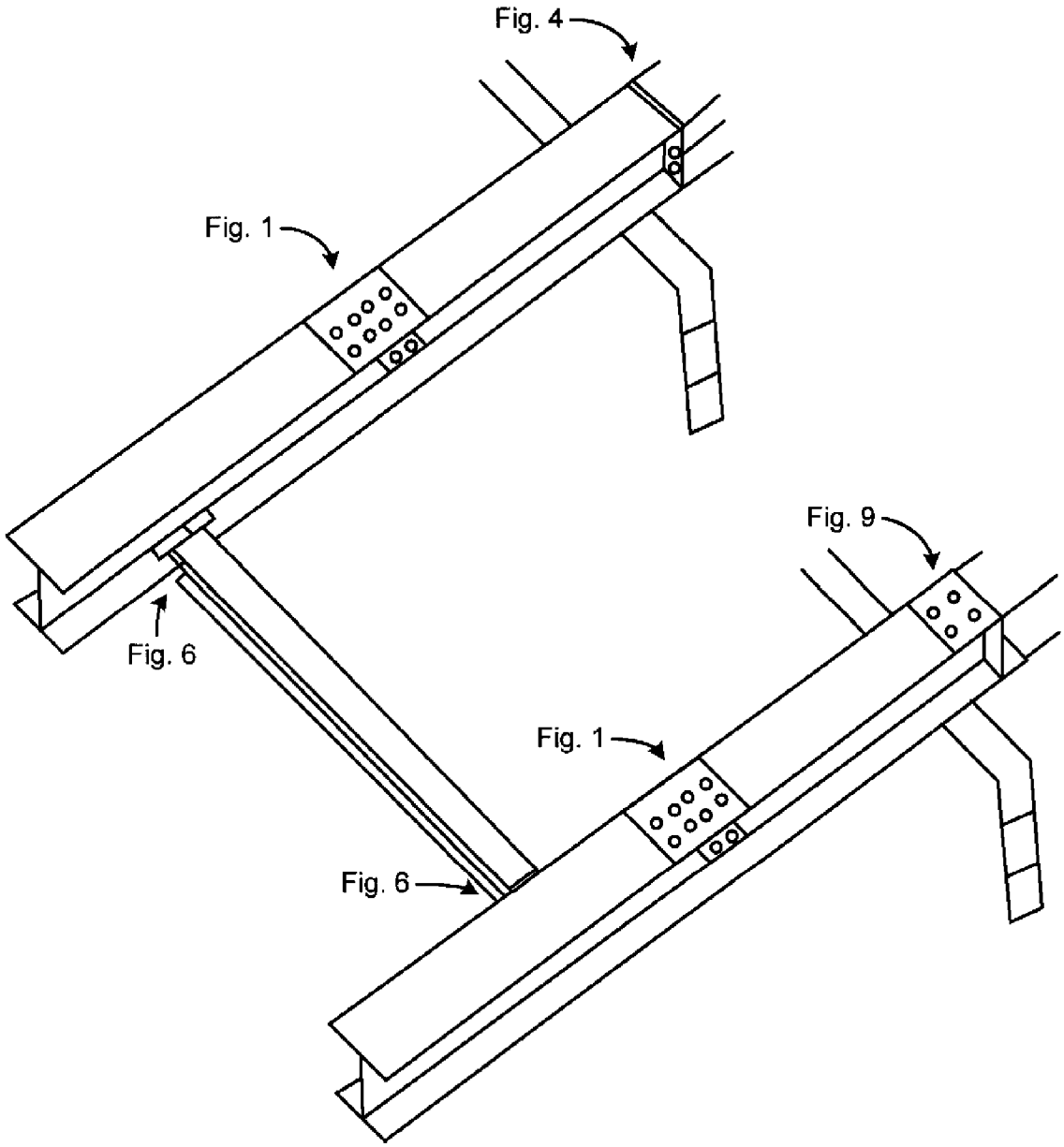
FIG. 11A PRIOR ART
FIG. 11A shows part of a construction formed by connecting beams together using several conventional techniques and FIG. 11B shows part of a construction formed according to preferred embodiments of the present invention.
Figure 11B:
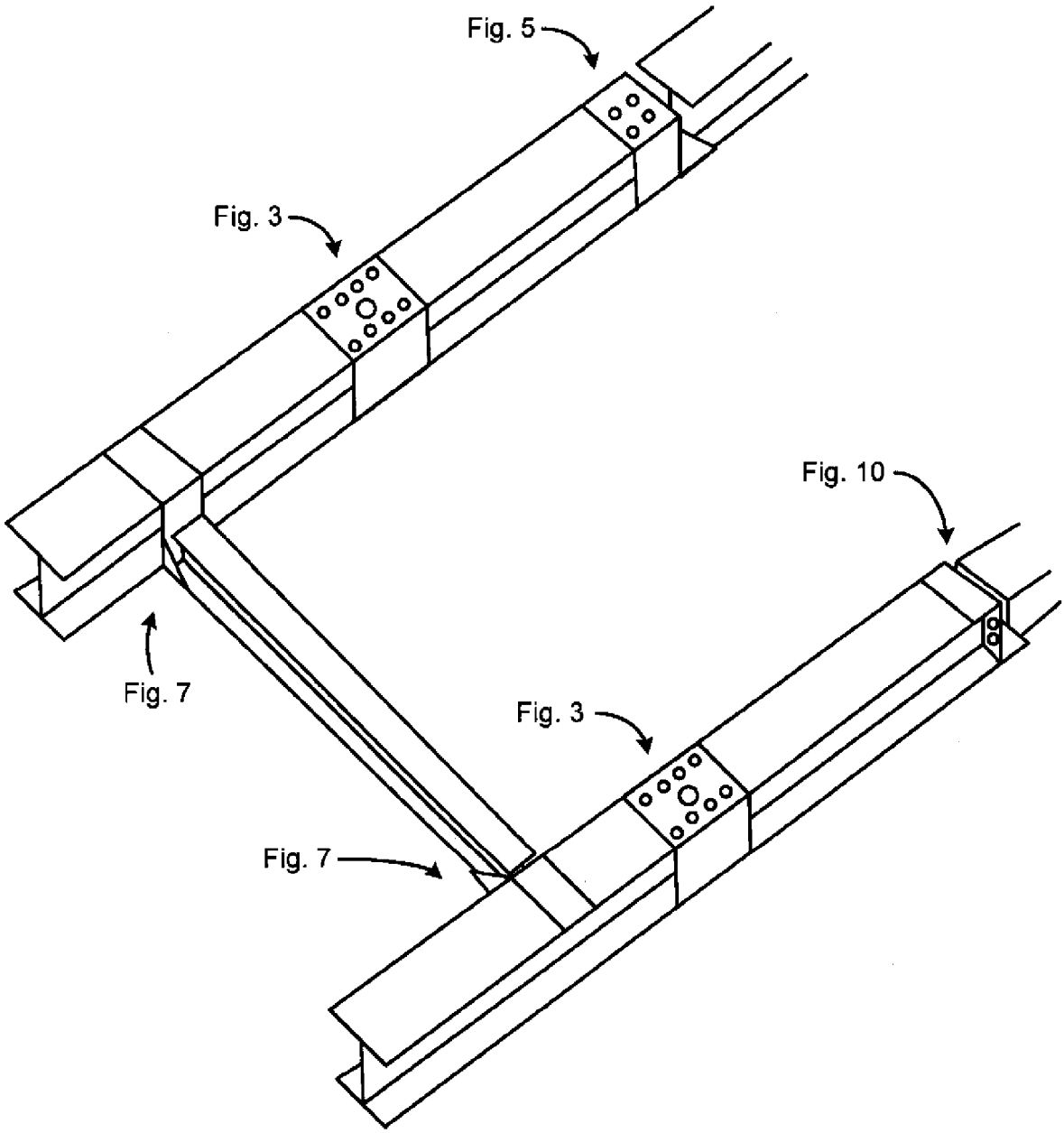

FIGS. 11A-11B show construction layouts utilising the conventional beam connecting techniques described herein and the techniques of the preferred embodiments respectively.

The construction of FIG. 11A includes all of the conventional techniques shown and described in relation to FIGS. 1, 4, 6 and 9. It will be appreciated that the construction is highly labour intensive and may take several days to design, manufacture and fabricate.

The construction of FIG. 11B includes the connection assemblies of the preferred embodiments shown and described in relation to FIGS. 3, 5, 7 and 10. As the connection devices are easily fitted and moved, precise designing and exact measurements of the connection components and positions are not required. Instead, the builder is able to take the beams and standardised connection components and fit them together at the construction site on the same day. If errors in the construction are made then a connection assembly may be removed, a beam replaced and the connection assembly refitted with minimal time, effort and cost.

The invention claimed is:

1. A connector device comprising:

a sleeve connecting first and second elongated metal beams, said sleeve having openings receiving end portions of said metal beams and opposing walls extending between said openings, wherein said sleeve is configured to receive metal girders for use in construction, wherein metal girders comprise the metal beams;

a plurality of threaded fasteners coupled to one of the opposing walls and compressing said metal beams within said sleeve so as to clamp the metal beams in a fixed position relative to each other within said sleeve; and an open viewing aperture located in a wall of said sleeve positioned approximately half-way between said openings for receiving said metal beams, wherein the viewing aperture enables a user to view said end portions of said metal beams to determine when said metal beams are located in a correct position within said sleeve.

2. A connector sleeve as claimed in claim 1, wherein said sleeve is configured to receive metal beams having a dimension perpendicular to the axis of the beam selected from the group consisting of: ≧60 mm; ≧80 mm; ≧100 mm; ≧120 mm; ≧140 mm; ≧160 mm; ≧180 mm; ≧200 mm; ≧220 mm; ≧240 mm; ≧260 mm; ≧280 mm; and ≧300 mm.

3. A connector sleeve as claimed in claim 1, wherein said plurality of threaded fasteners are configured to releasably engage said metal beams.

4. A connector sleeve as claimed in claim 1, wherein at least part of said plurality of threaded fasteners is permanently coupled to a wall of the sleeve.

5. A connector sleeve as claimed in claim 1, wherein said plurality of threaded fasteners is provided on one of two opposing walls of said sleeve, and clamps said metal beams against the other opposing wall in use.

6. A connector sleeve as claimed in claim 1, wherein said plurality of threaded fasteners comprises at least two bolts and corresponding bolt receiving means which are configured to co-operate so as to maintain said bolts in contact with said metal beams in use.

7. A connector sleeve as claimed in claim 6, wherein each of said bolt receiving means is permanently coupled to a wall of said sleeve.

8. A connector sleeve as claimed in claim 6, wherein each of said bolt receiving means comprises a bore for receiving said bolt, and wherein said bore is located about an aperture in a wall of the sleeve so that said bolt can pass through said bore and said sleeve wall and into contact with the metal beam in use.

9. A connector sleeve as claimed in claim 6, wherein said bolt is externally screw threaded and said bolt receiving means is internally screw threaded.

10. A connector sleeve as claimed in claim 1, wherein said sleeve is configured to extend around four sides of each of said metal beams so as to substantially enclose the entire circumference of said end portions of said metal beams in use.

11. A connector sleeve as claimed in claim 1, wherein said sleeve comprises substantially square or rectangular openings for receiving said metal beams.

12. A connector sleeve as claimed in claim 1 wherein said connector sleeve is configured to receive said first and second elongated metal beams such that they are co-linear with their end faces facing each other within said sleeve.

13. A connector sleeve as claimed in claim 1, wherein said openings are substantially square or rectangular openings;

wherein said plurality of threaded fasteners are movable into engagement with said metal beams in use and wherein said plurality of threaded fasteners comprises at least two bolts and corresponding bolt receiving means which are configured to co-operate so as to maintain said metal beams clamped in use;

wherein said connector sleeve is configured to receive said first and second metal beams such that they are co-linear and their end faces face each other within said sleeve; and wherein said sleeve is configured to receive metal weight bearing beams having a width of≧60 mm and a height of≧120 mm.

14. A method of connecting two beams comprising inserting the end portions of first and second beams into the connector sleeve of claim 1 and clamping said beams in a fixed position relative to each other within said sleeve using said plurality of threaded fasteners.

15. A method of constructing part of a building comprising a method as claimed in claim 14.

16. A modular connection assembly for connecting first and second beams, said connection assembly comprising:

a connector sleeve comprising opposing walls defining a region therebetween for receiving a portion of a first beam, and further comprising a side or end wall for connecting to a beam hanger, wherein said sleeve is provided with a plurality of threaded fasteners movable into compressive engagement with said first beam in use so as to clamp said first beam in a fixed position between said opposing walls, wherein said plurality of threaded fasteners is provided on one of said opposing walls of said sleeve and wherein said plurality of threaded fasteners clamps said first beam against another of said opposing walls in use;

the beam hanger configured to receive and support a second beam in use; and connecting means for connecting said connector sleeve to said beam hanger thereby connecting said first and second beams to one another in use;

wherein said beam hanger is an end box defining an interior space and having an opening for receiving the end portion of said second beam in use, wherein said end box comprises an end wall for connecting to said connector sleeve side or end wall using said connecting means, and a base wall for supporting the end of said second beam in use, wherein said end box further comprises opposing side walls joining said end box end wall and base wall.

17. A connection assembly as claimed in claim 16, wherein said connector sleeve is an end box defining an interior space and having an opening for receiving the end portion of said first beam in use.

18. A connection, assembly as claimed in claim 16, wherein said connector sleeve comprises two openings at opposite ends thereof such that said connector sleeve may be slid onto the first beam so that the first beam extends through and between the openings, and wherein said side wall of the connector sleeve extends between said openings.

19. A connection assembly as claimed in claim 18, wherein said connector sleeve comprises substantially square or rectangular openings for receiving said first beam.

20. A connection assembly as claimed in claim 16, wherein said side or said end wall of said connector sleeve comprises at least one aperture for use in connecting said connector sleeve and said beam hanger with said connecting means.

21. A connection assembly as claimed in claim 16, wherein said opposing walls are configured for receiving a flange of said first beam therebetween in use.

22. A connection assembly as claimed in claim 21, wherein said connector sleeve comprises an upper wall for contacting an upper side of said first beam and said end wall extends along a lateral side or free end of the first beam in use.

23. A connection assembly as claimed in claim 22, wherein said upper wall comprise a lipped portion forming said opposing walls for receiving said flange therebetween in use.

24. A connection assembly as claimed in claim 22, wherein said opposing walls for receiving said flange therebetween are formed by said upper wall and a lower wall, each of which is connected to said end wall.

25. A connection assembly as claimed in claim 24, wherein said lower wall is divided into two spaced apart portions which are each joined to said end wall so that a portion of said first beam may be received between said spaced apart portions in use.

26. A connection assembly as claimed in claim 25, wherein said clamping means is provided on one or both of said spaced apart portions.

27. A connection assembly as claimed in claim 21, wherein said end wall comprises at least one aperture for use in connecting said connector sleeve and beam hanger with said connecting means.

28. A connection assembly as claimed in claim 21, wherein said connector sleeve further comprising two connector sleeves for receiving said first beam in use.

29. A connection assembly as claimed in claim 16, wherein said plurality of threaded fasteners is configured to releasably engage said first beam.

30. A connection assembly as claimed in claim 16, wherein at least part of said plurality of threaded fasteners is permanently coupled to one of said opposing walls.

31. A connection assembly as claimed in claim 16, wherein said plurality of threaded fasteners comprises at least one bolt and a corresponding bolt receiving means which are configured to co-operate so as to maintain said bolt in contact with said first beam in use.

32. A connection assembly as claimed in claim 31, wherein said bolt receiving means is permanently coupled to one of said opposing walls.

33. A connection assembly as claimed in claim 31, wherein the at least one bolt receiving means comprises a bore for receiving said bolt and wherein said bore is located about an aperture in one of said opposing walls so that said bolt can pass through said bore and said opposing wall and into contact with said first beam in use.

34. A connection assembly as claimed in claim 16, wherein said beam hanger comprises an end wall for connecting to said connector sleeve end wall using said connecting means, and a base wall for supporting the end of said second beam in use.

35. A connection assembly as claimed in claim 34, wherein said beam hanger end wall comprises at least one aperture for use in connecting said beam hanger end wall to said connector sleeve using said connecting means.

36. A connection assembly as claimed in claim 34, wherein said base wall comprises at least one slot-shaped aperture in which a refastenable locking member is slideably mounted.

37. A connection assembly as claimed in claim 34, wherein said beam hanger further comprises opposing side walls joining said beam hanger end wall and base wall.

38. A connection assembly as claimed in claim 37, wherein at least one of said side walls comprises at least one aperture.

39. A connection assembly as claimed in claim 34, wherein said beam hanger is an end box defining an interior space and having an opening for receiving the end portion of said second beam in use.

40. A connection assembly as claimed in claim 39, wherein said beam hanger end wall is located on an opposite end of said beam hanger end box to said opening for receiving said second beam.

41. A connection assembly as claimed in claim 16, wherein said connecting means comprises means to releasably connect said connector sleeve and beam hanger.

42. A connection assembly as claimed in claim 16, wherein said connecting means comprises at least one bolt and at least one corresponding bolt receiving member.

43. A construction comprising a connection assembly as claimed in claim 16 and further comprising said first beam clamped in said connector sleeve and said second beam arranged in said beam hanger.

44. A method of connecting first and second beams using the connection assembly of claim 16, said method comprising: arranging said connector sleeve so as to receive a portion of said first beam between said opposing walls; clamping said first beam in a fixed position between said opposing walls using said plurality of threaded fasteners; connecting said beam hanger to said connector sleeve using said connecting means; and inserting a second beam into said beam hanger.

45. The connection assembly of claim 16, wherein said first and second beams further comprise metal beams.

46. The connection assembly of claim 16, wherein the beam hanger and the sleeve connect the first beam and the second beam at a substantially orthogonal angle.

47. A modular connection assembly for connecting first and second beams, said connection assembly comprising:

a connector sleeve comprising opposing walls defining a region therebetween for receiving a portion of a first beam, and further comprising a side or end wall for connecting to a beam hanger, wherein said sleeve is provided with a plurality of threaded fasteners movable into compressive engagement with said first beam in use so as to clamp said first beam in a fixed position between said opposing walls;

the beam hanger configured to receive and support a second beam in use; and connecting means for connecting said connector sleeve to said beam hanger thereby connecting said first and second beams to one another in use;

wherein said beam hanger is an end box defining an interior space and having an opening for receiving the end portion of said second beam in use, wherein said end box comprises an end wall for connecting to said connector sleeve side or end wall using said connecting means, and a base wall for supporting the end of said second beam in use, wherein said end box further comprises opposing side walls joining said end box end wall and base wall, wherein said connecting means comprises an adaptor plate configured to be connectable to said connector sleeve and beam hanger.

48. A connection assembly as claimed in claim 47, wherein said adaptor plate comprises at least two apertures for use in connecting the adaptor plate to said connector sleeve and beam hanger.

* * * * *